US012319388B2

(12) United States Patent
Gifford

(10) Patent No.: US 12,319,388 B2
(45) Date of Patent: Jun. 3, 2025

(54) LOAD LIFTER ASSEMBLY

(71) Applicant: Charles L Gifford, Camanche, IA (US)

(72) Inventor: Charles L Gifford, Camanche, IA (US)

(73) Assignee: JJB SOLUTIONS LLC, Camanche, IA (US)

( * ) Notice: Subject to any disclaimer, the term of this patent is extended or adjusted under 35 U.S.C. 154(b) by 0 days.

(21) Appl. No.: 18/406,085

(22) Filed: Jan. 5, 2024

(65) Prior Publication Data

US 2024/0253744 A1 Aug. 1, 2024

Related U.S. Application Data

(63) Continuation-in-part of application No. 17/226,063, filed on Apr. 8, 2021, now Pat. No. 11,999,595.

(60) Provisional application No. 63/478,606, filed on Jan. 5, 2023, provisional application No. 63/006,722, filed on Apr. 8, 2020.

(51) Int. Cl.
*B63B 27/16* (2006.01)

(52) U.S. Cl.
CPC ..... *B63B 27/16* (2013.01)

(58) Field of Classification Search
CPC ..... B66C 1/28; B63B 27/12; B63B 27/16
USPC ..... 294/81.56, 67.31, 67.32
See application file for complete search history.

(56) References Cited

U.S. PATENT DOCUMENTS 718,506 A 1/1903 Normandin
758,288 A 4/1904 Williams
858,772 A 7/1907 Williams
906,364 A 12/1908 Williams
1,016,979 A 2/1912 Williams
1,041,495 A 10/1912 Liggett et al.
1,085,692 A 2/1914 Liggett
1,266,894 A 5/1918 Williams
RE14,865 E 6/1918 Plaisted
RE14,920 E 4/1919 Plaisted
1,433,042 A 10/1922 Sedberry
1,444,990 A 2/1923 Wauthier
1,630,021 A 5/1927 Lucas
1,678,723 A 7/1928 Clement
1,693,058 A 11/1928 Shelton
1,759,905 A 5/1930 Keith
1,760,097 A 5/1930 Williams
1,761,038 A 6/1930 Liggett
1,787,526 A 1/1931 Honstain
1,821,912 A 9/1931 Pfeiffer
1,827,986 A 10/1931 Inglehart
1,829,325 A 10/1931 Alfred
1,854,844 A 4/1932 Kaemmerling
1,889,129 A 11/1932 Christian
1,911,718 A 5/1933 Saunders
1,954,175 A 4/1934 Jensen
1,997,553 A 4/1935 Taylor et al.
2,015,581 A 9/1935 Armour
2,207,455 A 7/1940 Clement
2,237,510 A 4/1941 Tankersley
2,244,577 A 6/1941 Schreiber
2,404,778 A 7/1946 Allison
2,531,597 A 11/1950 Anderson
2,566,758 A 9/1951 Anderson
(Continued)

*Primary Examiner* — Lynn E Schwenning
(74) *Attorney, Agent, or Firm* — HAMILTON IP LAW; Jay R. Hamilton

(57) ABSTRACT

A Load Lifter Assembly is configured to allow for lifting, moving and releasing a barge lid via a material hander such as a crane without need for manual intervention between the load lifter assembly and the barge lid.

6 Claims, 50 Drawing Sheets

(56) References Cited

U.S. PATENT DOCUMENTS

| | | | |
|---|---|---|---|
| 2,566,798 | A | 9/1951 | Hiller |
| 2,602,597 | A | 7/1952 | Ball |
| 2,607,538 | A | 8/1952 | Larson |
| 2,763,439 | A | 9/1956 | Mankoff |
| 2,857,194 | A | 10/1958 | Brown |
| 2,946,618 | A | 7/1960 | Klahn et al. |
| 3,045,934 | A | 7/1962 | Eilers |
| 3,058,676 | A | 10/1962 | Hermann |
| 3,222,854 | A | 12/1965 | Barth |
| 3,278,126 | A | 10/1966 | Ratkowski |
| 3,322,356 | A | 5/1967 | Toews |
| 3,379,383 | A | 4/1968 | Stepanek |
| 3,424,488 | A | 1/1969 | Renfroe |
| 3,437,369 | A | 4/1969 | Gealy |
| 3,482,789 | A | 12/1969 | Newell |
| 3,549,095 | A | 12/1970 | Ratkowski |
| 3,558,178 | A | 1/1971 | Taylor |
| 3,598,008 | A | 8/1971 | Jacobson et al. |
| 3,627,212 | A | 12/1971 | Stanton |
| 3,738,586 | A | 6/1973 | Fabert |
| 4,129,262 | A | 12/1978 | Lowry |
| 4,141,512 | A | 2/1979 | Francis |
| 4,142,687 | A | 3/1979 | Potwin |
| 4,162,767 | A | 7/1979 | Hahn |
| 4,177,956 | A | 12/1979 | Fawcett |
| 4,310,125 | A | 1/1982 | Novotny |
| 4,341,353 | A | 7/1982 | Hamilton et al. |
| 4,343,438 | A | 8/1982 | Slikas et al. |
| 4,352,774 | A | 10/1982 | Hornberger |
| 4,406,415 | A | 9/1983 | Greer |
| 4,558,826 | A | 12/1985 | Martinek |
| 4,729,516 | A | 3/1988 | Williams, Jr. |
| 4,795,103 | A | 1/1989 | Lech |
| 4,856,170 | A | 8/1989 | Kachik |
| 4,907,750 | A | 3/1990 | Seifert |
| 4,915,310 | A | 4/1990 | Stelk |
| 5,002,233 | A | 3/1991 | Williams |
| 5,072,888 | A | 12/1991 | Stelk |
| 5,364,038 | A | 11/1994 | Prew |
| 5,377,919 | A | 1/1995 | Rogers et al. |
| 5,381,975 | A | 1/1995 | Chon |
| 5,443,216 | A | 8/1995 | Lajoie |
| 5,465,912 | A | 11/1995 | Graybill |
| 5,476,300 | A | 12/1995 | Dodge |
| 5,605,291 | A | 2/1997 | Doskocil |
| 5,611,496 | A | 3/1997 | Fleenor |
| 5,628,467 | A | 5/1997 | Graveman |
| 5,692,688 | A | 12/1997 | Waitman et al. |
| 5,722,607 | A | 3/1998 | Hellmich |
| 5,842,653 | A | 12/1998 | Elliott et al. |
| 5,904,306 | A | 5/1999 | Elliott et al. |
| 6,045,072 | A | 4/2000 | Zehr |
| 6,131,838 | A | 10/2000 | Balvanz |
| 6,142,400 | A | 11/2000 | Balvanz et al. |
| 6,260,778 | B1 | 7/2001 | Wenger |
| 6,299,082 | B1 | 10/2001 | Smith |
| 6,364,227 | B1 | 4/2002 | Dorscht |
| 6,419,173 | B2 | 7/2002 | Balvanz et al. |
| 6,481,654 | B1 | 11/2002 | Balvanz |
| 6,517,020 | B1 | 2/2003 | Smith |
| 6,622,951 | B1 | 9/2003 | Recker |
| 6,971,598 | B2 | 12/2005 | Schillinger et al. |
| 7,140,569 | B2 | 11/2006 | Young |
| D536,350 | S | 2/2007 | Young |
| D536,351 | S | 2/2007 | Young |
| D536,352 | S | 2/2007 | Young |
| D544,503 | S | 6/2007 | Young |
| D544,504 | S | 6/2007 | Young |
| D545,327 | S | 6/2007 | Young |
| D545,328 | S | 6/2007 | Young |
| D545,846 | S | 7/2007 | Young |
| D545,847 | S | 7/2007 | Young |
| D550,728 | S | 9/2007 | Young |
| D551,266 | S | 9/2007 | Young |
| D551,267 | S | 9/2007 | Young |
| D552,638 | S | 10/2007 | Willibald |
| D552,639 | S | 10/2007 | Young |
| D555,679 | S | 11/2007 | Young |
| 7,325,761 | B2 | 2/2008 | Chen et al. |
| D573,163 | S | 7/2008 | Young |
| 7,419,109 | B1 | 9/2008 | Ronfeldt et al. |
| D588,174 | S | 3/2009 | Young |
| 7,559,497 | B2 | 7/2009 | Young |
| 7,621,477 | B2 | 11/2009 | Young |
| D616,002 | S | 5/2010 | Willibald |
| 7,819,352 | B2 | 10/2010 | Young |
| 8,562,047 | B2 | 10/2013 | Parker |
| 9,290,370 | B1 | 3/2016 | Panio et al. |
| 9,434,580 | B2 | 9/2016 | Bakalyar |
| 10,435,281 | B1 | 10/2019 | Morris |
| 10,947,096 | B2 | 3/2021 | Morris |
| 2002/0190148 | A1 | 12/2002 | Roozeboom et al. |
| 2004/0017955 | A1 | 1/2004 | Schillinger et al. |
| 2006/0032958 | A1 | 2/2006 | Young |
| 2007/0023554 | A1 | 2/2007 | Young |
| 2009/0321546 | A1 | 12/2009 | Plumb et al. |
| 2010/0025511 | A1 | 2/2010 | Young |
| 2010/0090047 | A1 | 4/2010 | Willibald |
| 2010/0213301 | A1 | 8/2010 | Hoice et al. |
| 2011/0042498 | A1 | 2/2011 | Young et al. |

LOAD LIFTER ASSEMBLY

CROSS REFERENCE TO RELATED APPLICATIONS

The present non-provisional patent application claims benefit of and is a continuation-in-part of non-provisional patent application U.S. patent application Ser. No. 17/226,063 filed on Apr. 8, 2021 which claims benefit of provisional U.S. Pat. Application Ser. No. 63/006,722 filed on Apr. 8, 2020. The present non-provisional patent application also claims priority from provisional U.S. Pat. App. No. 63/478,606 filed on Jan. 5, 2023. All of the preceding applications are incorporated by reference herein in their entireties.

FIELD OF THE INVENTION

The present disclosure relates to a Load Lifter Assembly which is useful in at least one embodiment for placement and removal of barge lids. One benefit of the of the Load Lifter Assembly as described and claimed herein is to improve safety as the Load Lifter Assembly does not require deckhands to engage with the barge lid during placement and removal.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. § 1.171 (c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

In the past a set of chains with (4) 19' long legs were used to hook the lids. It would require (2) guys on top of the lids to separate the chains and then walk them down the sides to hook them to the eyes of the lid. If setting lids on the dock, it took (2) more workers to guide the lid and then unhook the chains.

SUMMARY OF INVENTION

The Load Lifter Assembly as disclosed is a device that allows for hooking and unhooking barge covers (lids, typically made of fiberglass) unassisted. The Load Lifter Assembly as disclosed herein does not require any workers to hook or unhook for movement of the lid between the barge and the dock. It consists of a main body having four (4) attached legs and four (4) mechanical arms with hooks and guide wheels attached at the end of those legs. As nearly all river terminals use material handler(s) (a crane, a loader or a high-line) with a clamshell bucket, the Load Lifter Assembly is configured with a "T" shaped piece on top for the bucket to engage (clamshell pinches) to lift the Load Lifter Assembly. Additionally, there is a switch mechanism positioned in the center of the main body assembly that rotates a quarter turn each cycle (similar to a ball point pen). In the initial lift, the whole assembly is lifted. When the Load Lifter Assembly is set down on the lid, the switch mechanism in the center releases and rotates ninety (90) degrees engaging the load arms with the hooks to grab the eyes on the lids. Once the lid is sat back down, the switch mechanism in the center rotates ninety (90) degrees again, releasing the hooks allowing lifting of the device off of the barge lid.

BRIEF DESCRIPTION OF THE DRAWINGS

The accompanying drawings, which are incorporated in and constitute a part of this specification, illustrate embodiments and together with the description, serve to explain and illustrate the principles of the Load Lifter Assembly as disclosed herein.

FIG. 11A is a side view showing the latching eyes unlocked. FIG. 11B is a side view showing the latching eyes locked.

DETAILED DESCRIPTION-TABLE OF ELEMENTS-1st Embodiment

Figure 1:
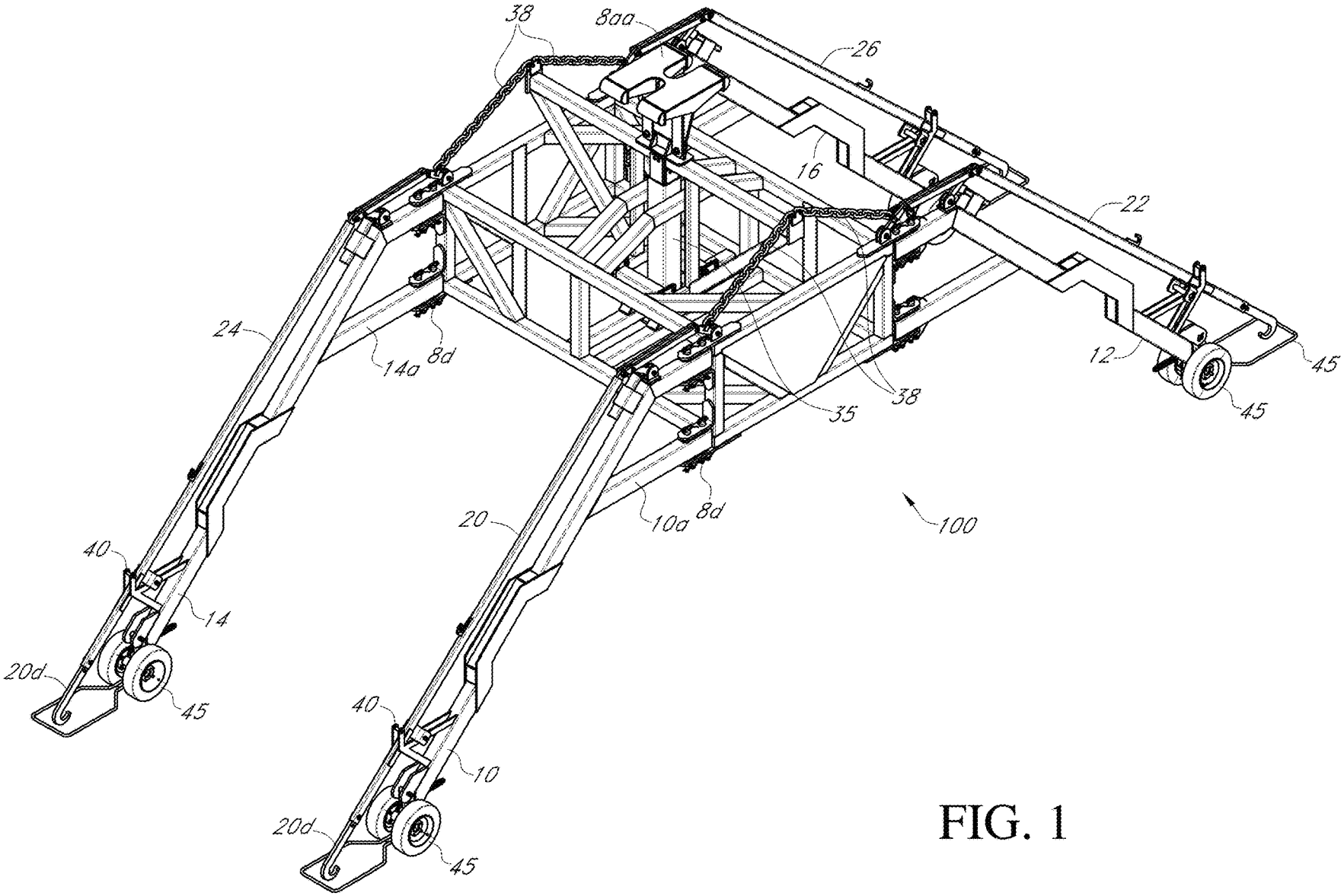
FIG. 1 is a perspective view of a 1$^{st}$ embodiment of the Load Lifter Assembly for enablement of the present disclosure.

| Element Description | Element Number |
|---|---|
| Barge lid | 1 |
| Barge lid edge | 1a |
| Barge lid ridge | 1b |
| Barge lid depression | 1c |
| Barge | 1d |
| Hooks/eyes of barge lid | 2 |
| Hook portion of eye | 2a |
| Eyelet portion | 2b |
| Bracket (eye) | 3 |
| Main body | 8 |
| Upper portion | 8a |
| Engagement end (T-shaped) | 8aa |
| Central portion | 8b |

-continued

| DETAILED DESCRIPTION-TABLE OF ELEMENTS-1st Embodiment | |
|---|---|
| Element Description | Element Number |
| Lower portion | 8c |
| Plates | 8d |
| Mounting eyes | 9 |
| Loading legs-first | 10 |
| Loading legs-first-first end | 10a |
| Loading legs-first-second end | 10b |
| Loading legs-second | 12 |
| Loading legs-second-first end | 12a |
| Loading legs-second-second end | 12b |
| Loading legs-third | 14 |
| Loading legs-third-first end | 14a |
| Loading legs-third-second end | 14b |
| Loading legs-fourth | 16 |
| Loading legs-fourth-first end | 16a |
| Loading legs-fourth-second end | 16b |
| Spring catch | 18 |
| Load arm assembly (1st) | 20 |
| 1st/2nd Drop-down member | 20a/20aa |
| Horizontal member | 20b |
| Rod | 20c |
| Hooked end | 20d |
| Load arm assembly (2nd) | 22 |
| Load arm assembly (3rd) | 24 |
| Load arm assembly (4th) | 26 |
| Master switch assembly (hydraulic control system) | 30 |
| Upper switch plate | 32 |
| Shaft | 33a |
| Upper blade | 33b |
| Lower blade | 33c |
| Lower switch plate | 34 |
| Lower wedges | 34a |
| Outer tube | 35 |
| Inner tube | 36 |
| Upper wedges | 37a |
| Slot | 37b |
| Chain | 38 |
| Spring | 39 |
| Guide assembly | 40 |
| Pin | 42 |
| Clevis | 43 |
| Guide wheels | 45 |
| Guard | 46 |
| Spring (compression) | 47 |
| Lifting Device (crane, loader, excavator) (not shown) | 50 |
| Working End (hook, cable, chain, loader bucket, excavator bucket) | 51 |
| Load Lifter Assembly | 100 |

DETAILED DESCRIPTION

Before the present Load Lifter Assembly 100 is disclosed and described, it is to be understood that the Load Lifter Assembly 100 is not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Figure 9:
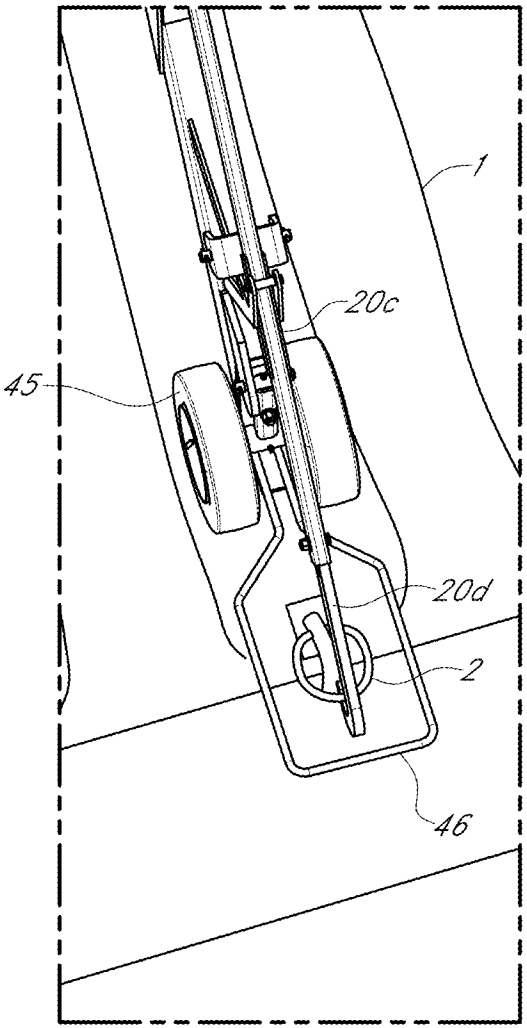
FIG. 9 illustrates the wheel of the load lifter assembly of FIG. 8 engaged with a ridge in the barge lid setting position of the hook for deployment and engagement with the barge lid.
Figure 10:
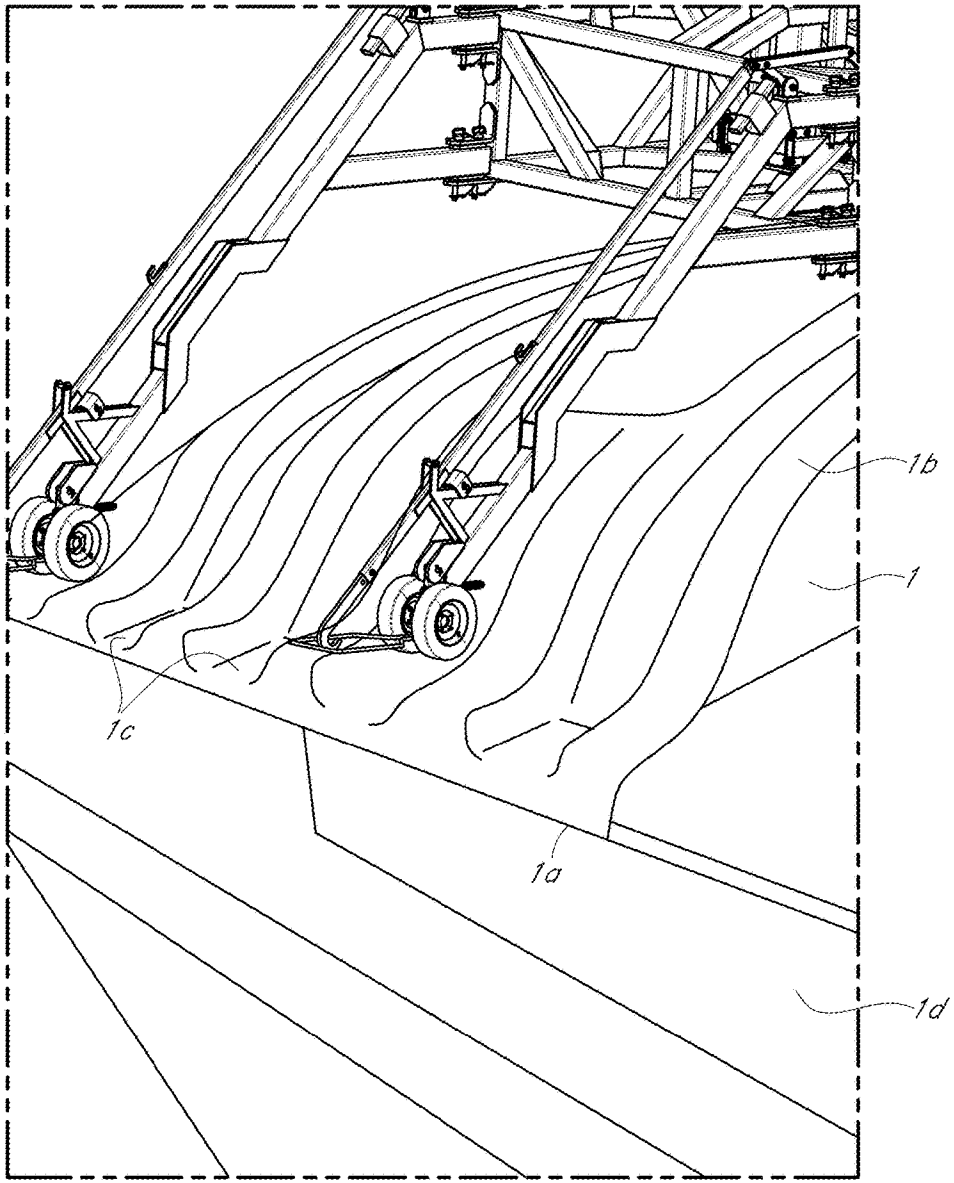
FIG. 10 illustrates the load lifter assembly of FIG. 8 with hooks engaged around the edge of the lid, the guide wheels engaged in the recesses of the lid and the lid being either removed or attached to the barge.
Figure 10A:
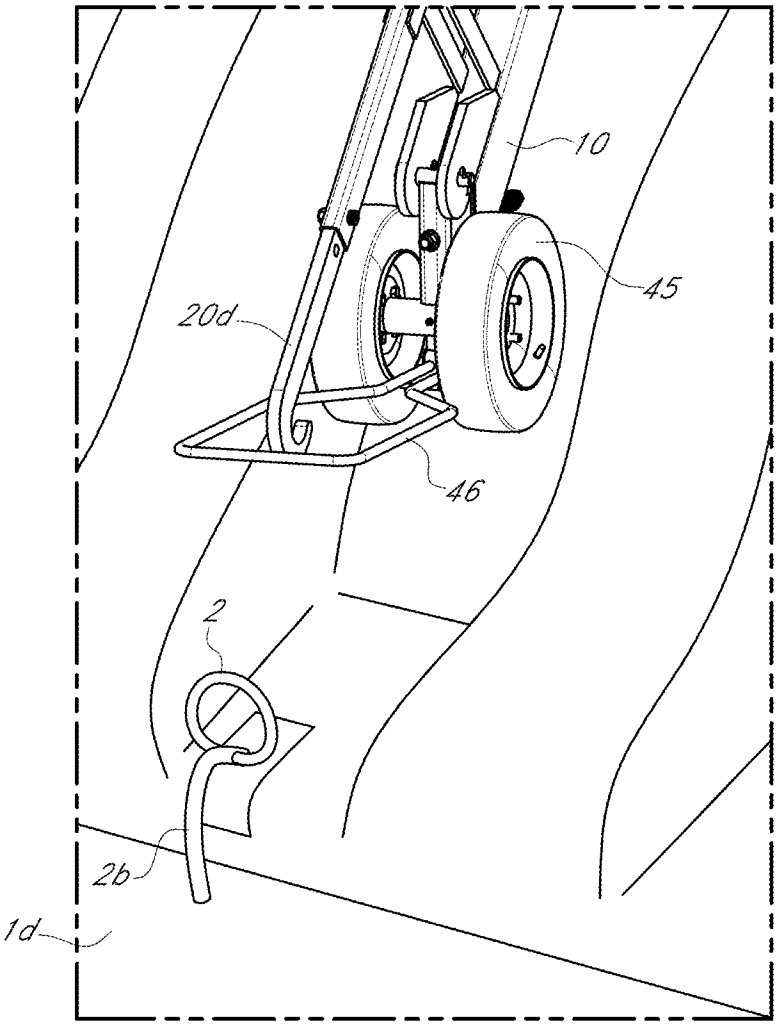
FIGS. 10A and 10B are a detailed view of the hook end of the load arm of FIG. 10 engaging with the eye of the barge lid to lock or unlock the lid to the barge.
Figure 11A:
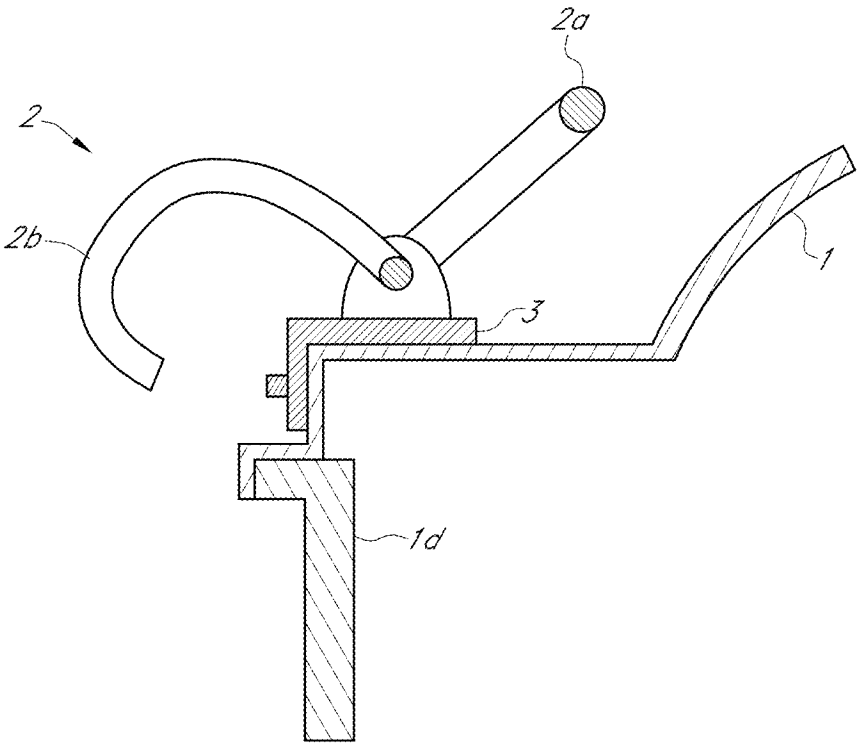
FIG. 11A (PRIOR ART)
FIGS. 11A-11B illustrate the prior art latching eyes of conventional barge lids.
Figure 11B:
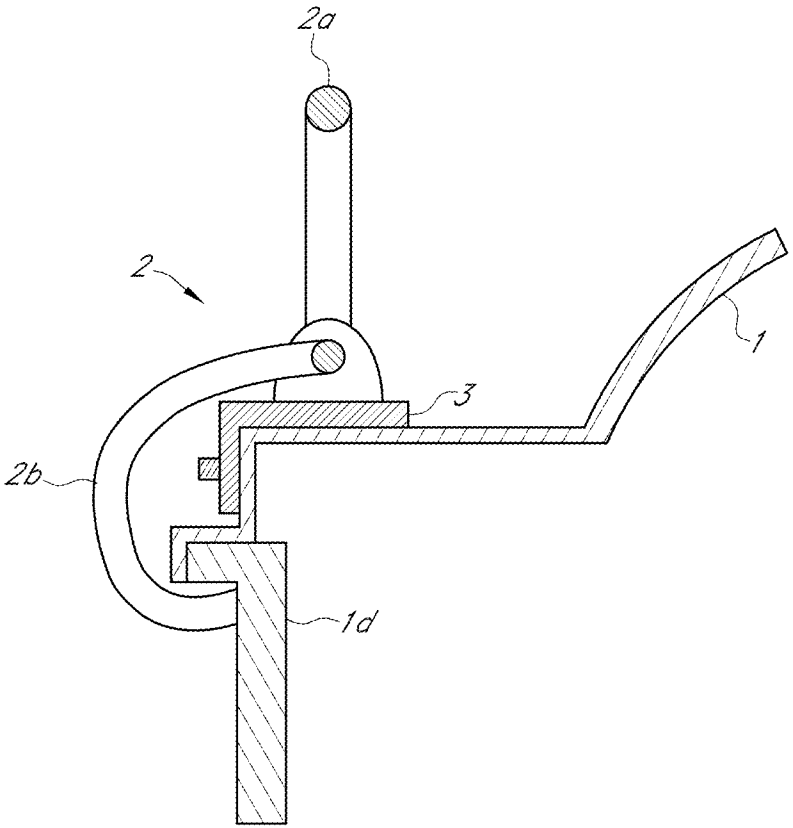
FIG. 11B (PRIOR ART)

Disclosed are components that can be used with at least one embodiment of the disclosed Load Lifter Assembly 100. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all potential embodiments of the Load Lifter Assembly 100. This applies to all aspects of this application including, but not limited to, components of a Load Lifter Assembly 100. Thus, if there are a variety of additional components that can be added it is understood that each of these additional components can be added with any specific embodiment or combination of embodiments of the Load Lifter Assembly 100. The present Load Lifter Assembly 100 may be understood more readily by reference to the following detailed description of preferred embodiments and the examples included therein and to the Figures and their previous and following description. Generally, FIGS. 1-7 are engineering drawings made to assemble a prototype which is disclosed herein in sufficient detail as to enable one of ordinary skill in the art as to the invention. FIGS. 7-10 are various views of the Load Lifter Assembly 100 engaged with a barge lid during attachment and removal. FIGS. 11A-11B illustrate the prior art latching eyes of conventional barge lids.

1st Enabling Embodiment

FIG. 1 is a perspective view of the Load Lifter Assembly 100 disclosed herein along with detailed call outs for enablement of the present disclosure. As shown in FIG. 1, the Load Lifter Assembly 100 has four loading legs 10, 12, 14 and 16, respectively, for use in lifting operations of barge lids 1. The main (truss) body 8 has an upper portion 8*a* (upper assembly), a center portion 8*b* and a lower portion 8*c*. The upper portion 8*a* has an engagement end 8*aa* which is generally configured for engagement with the working end 51 (bucket, hook or clamshell as shown throughout) of a lifting device 50. As shown in the figures, it has a "T-shape" but is not so limited or restricted, as many other shapes may be suitable for a particular application.

Figure 1A:
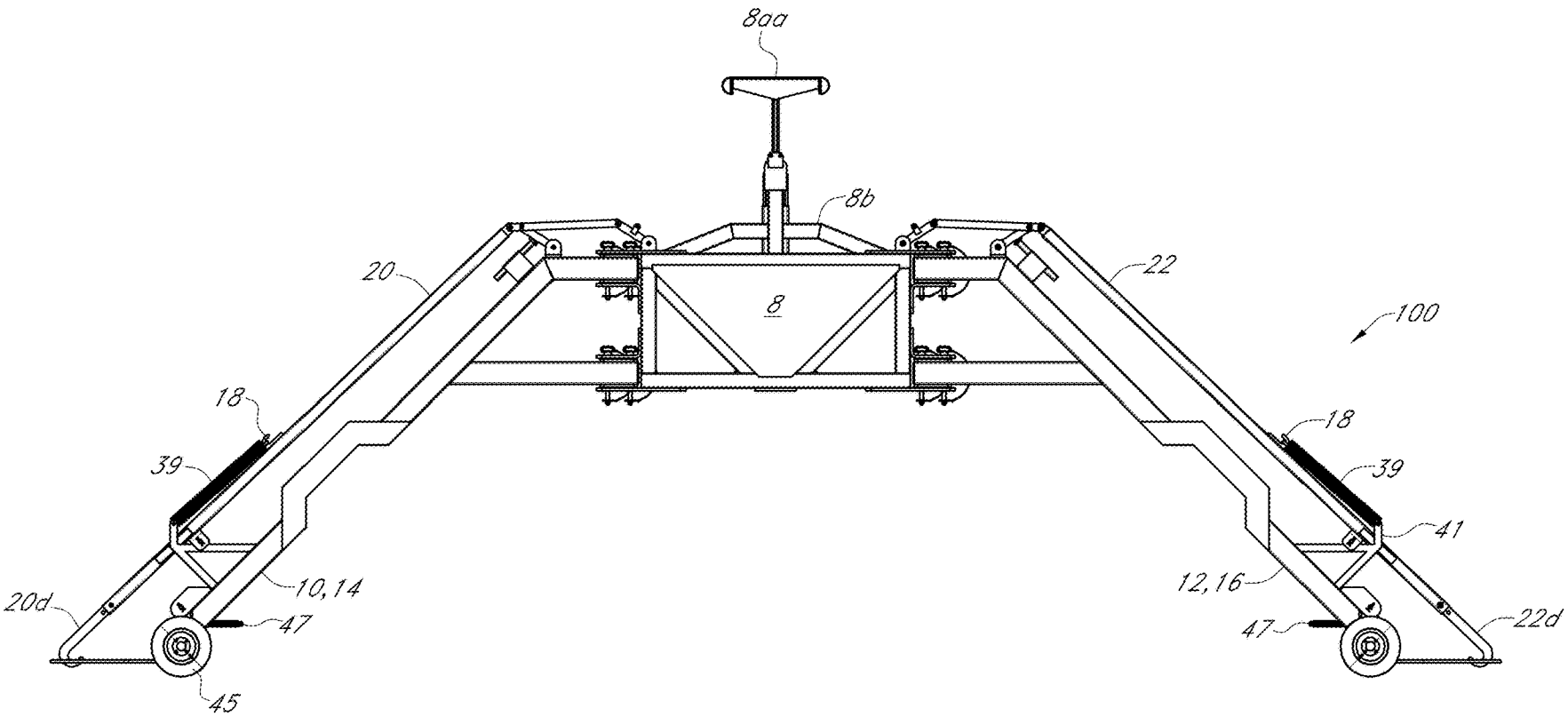
FIG. 1A is a side view of a 1$^{st}$ embodiment of the Load Lifter Assembly disclosed herein along with detailed call outs for enablement of the present disclosure.
Figure 1B:
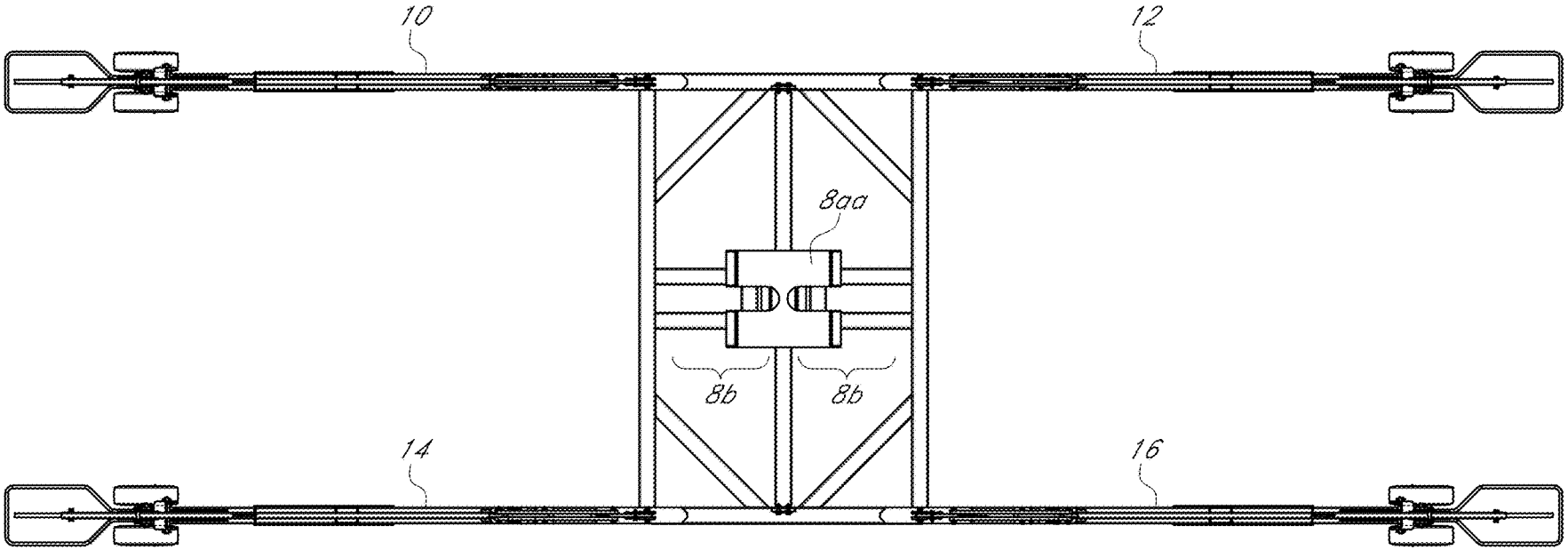
FIG. 1B is a top view of a 1$^{st}$ embodiment of the Load Lifter Assembly as shown at FIG. 1 along with detailed call outs for enablement of the present disclosure.
Figure 1C:
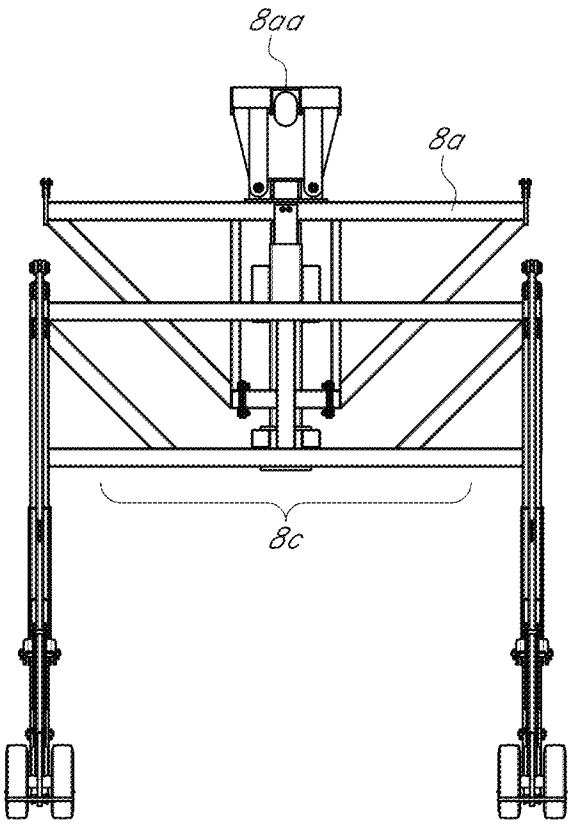
FIG. 1C is an end view of a 1$^{st}$ embodiment of the Load Lifter Assembly as shown at FIG. 1 along with detailed call outs for enablement of the present disclosure.
Figure 1D:
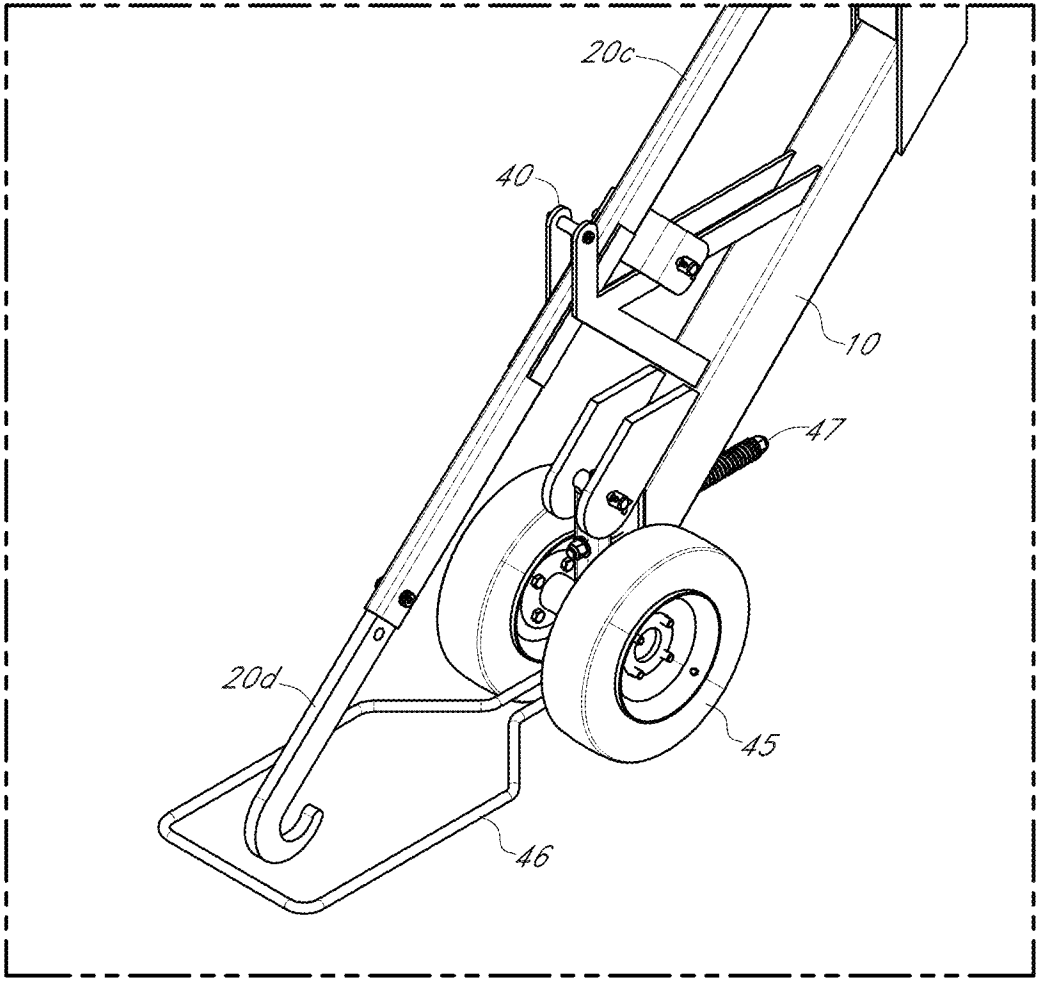
FIG. 1D is a detailed view of a 1$^{st}$ embodiment of the guide assembly of a loading leg assembly with the load arm assembly positioned in the guide.

See also FIG. 1A (side view), FIG. 1B (top view) and FIG. 1C (side view) of the Load Lifter Assembly as shown at FIG. 1 along with detailed call outs for enablement of the present disclosure. FIG. 1D is a detailed view of the guide assembly 40 of a loading leg assembly with the end of the load arm assembly positioned in the cradle like guard 46.

Figure 2:
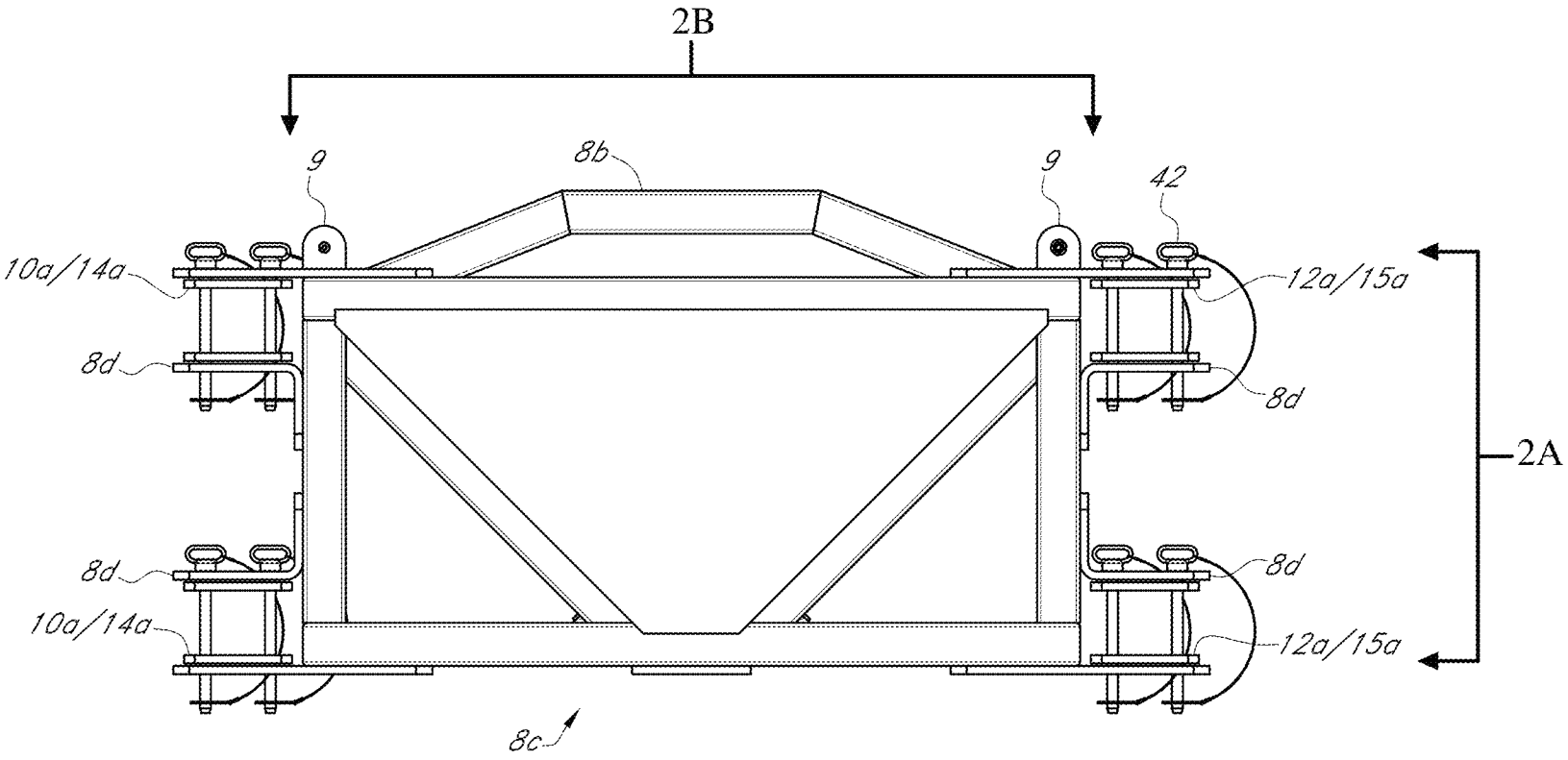
FIG. 2 is a detailed side view of a 1$^{st}$ embodiment of the truss body of the Load Lifter Assembly as shown throughout.
Figure 2A:
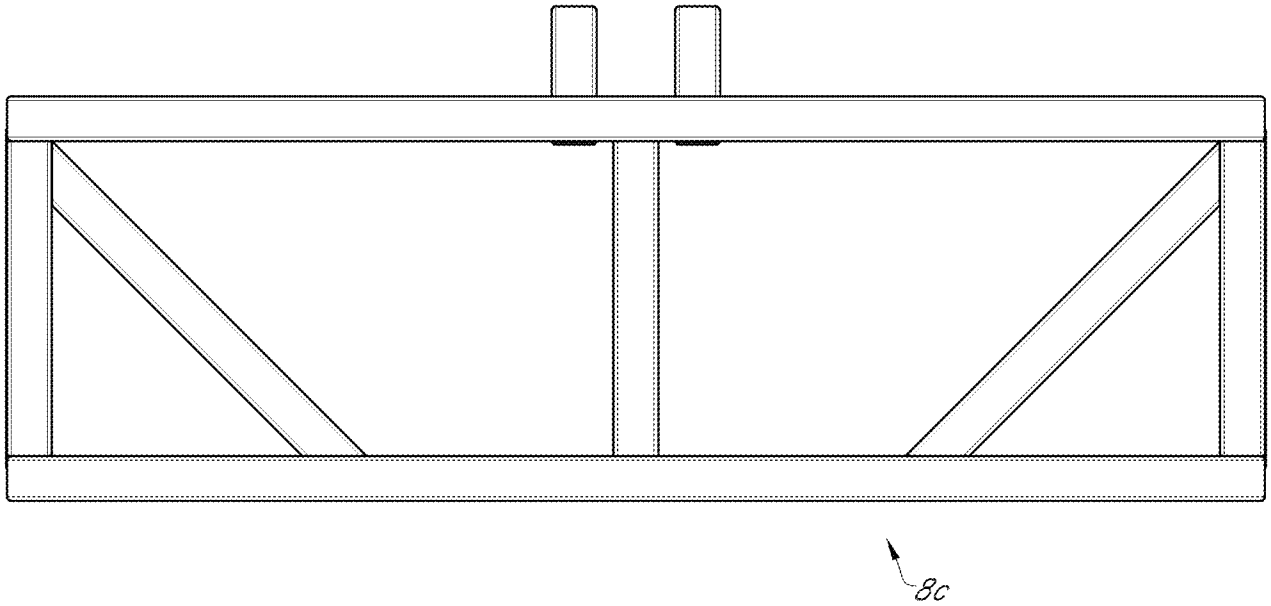
FIG. 2A is a detailed front view of a 1$^{st}$ embodiment of the truss body center portion of the Load Lifter Assembly as shown in FIGS. 2 and 2A.
Figure 2B:
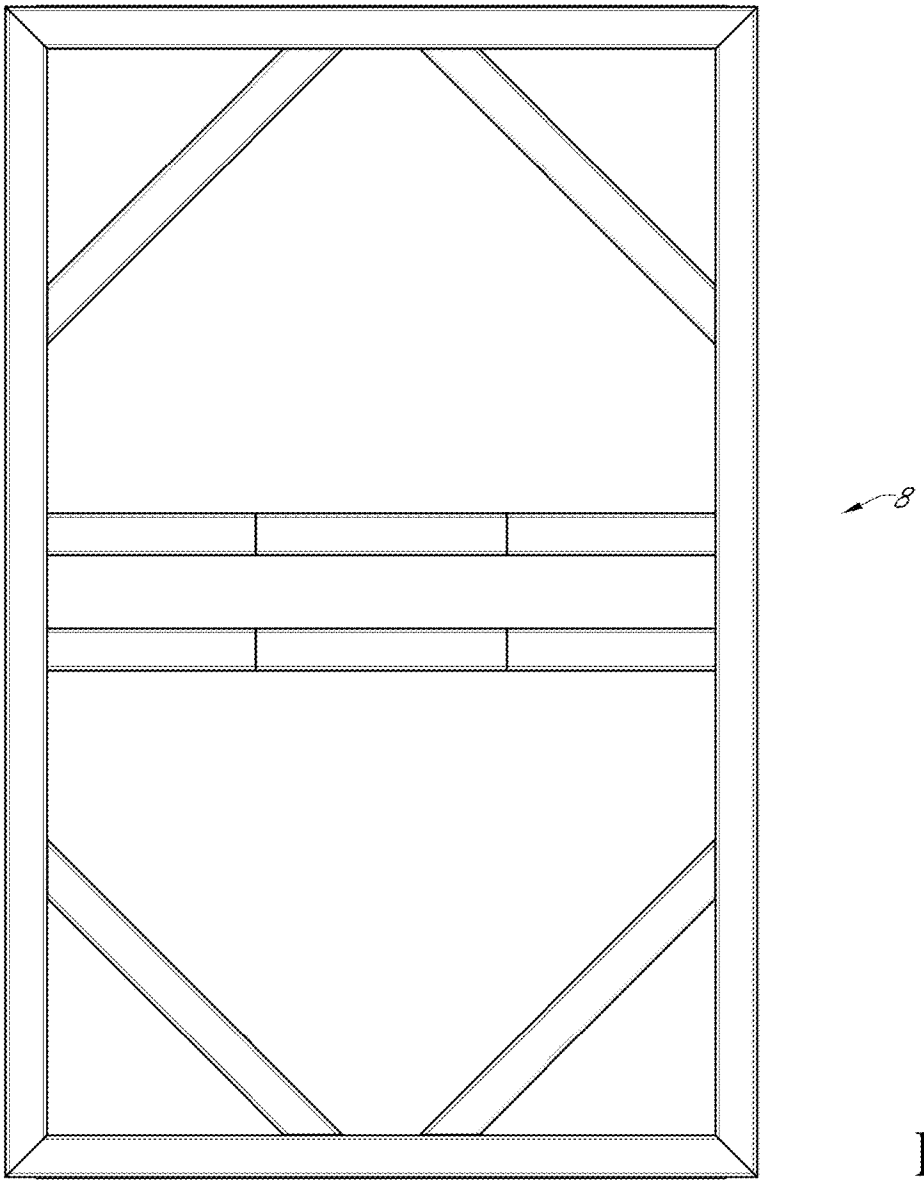
FIG. 2B is a top view of a 1$^{st}$ embodiment of the truss body center portion of the Load Lifter Assembly as shown in FIGS. 2 and 2A [plan view throughout].
Figure 2C:
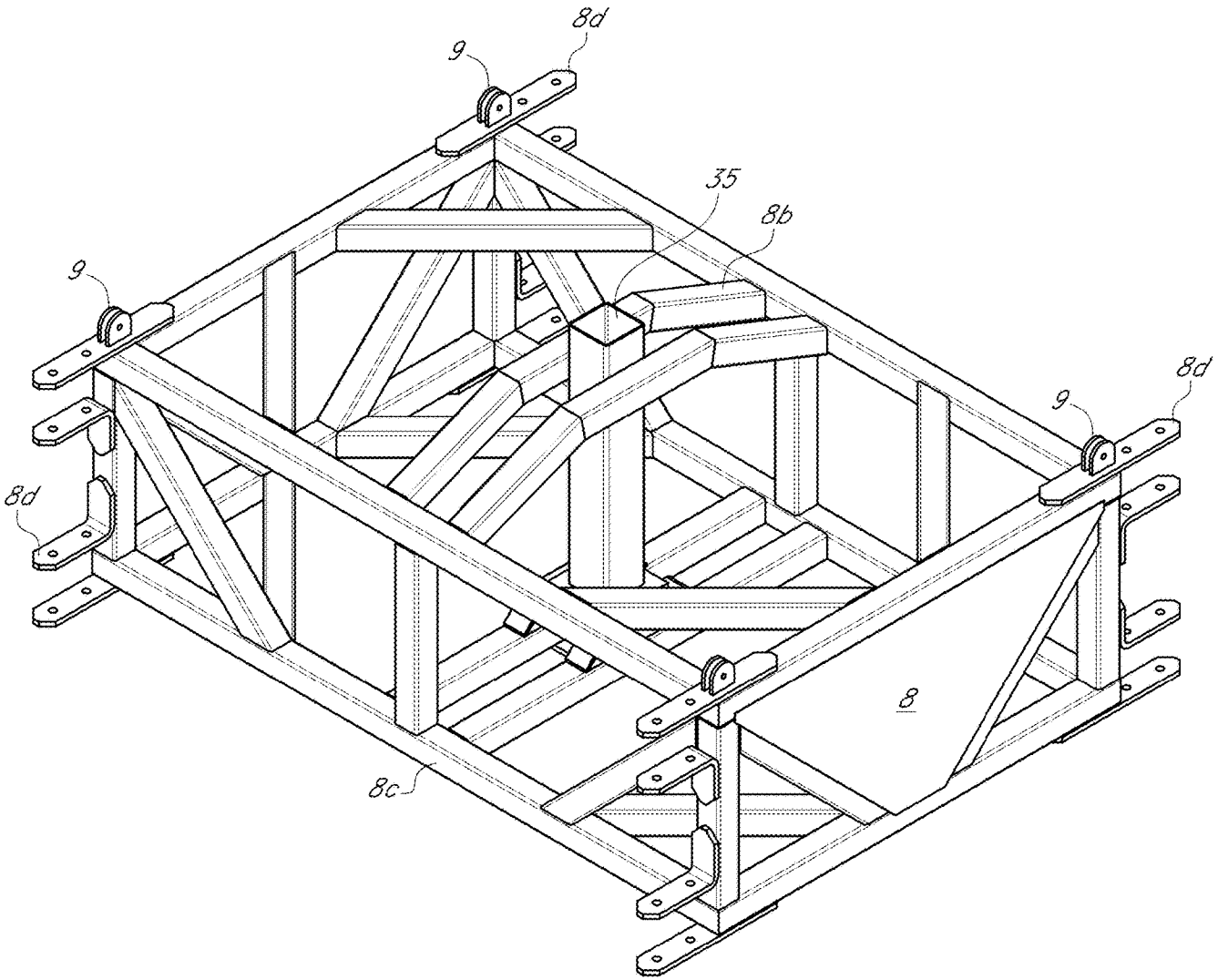
FIG. 2C is a perspective view of a 1$^{st}$ embodiment of the truss body of the Load Lifter Assembly as shown throughout.

As shown FIGS. 1-2C, the main (truss) body 8 of the Load Lifter Assembly 100 is positioned between the loading leg assemblies (10, 12, 14 and 16) and is generally configured as a central rectangular structure that can support the load placed upon it by the lifting device, the load legs and the load arms and is further comprised of multiple cross members and supporting struts.

FIG. 2 is a detailed side view of the truss body (main 8) of the Load Lifter Assembly 100 as shown throughout. Further, at each corner of the main body 8, on each side, plates (8*d*) have been welded to allow attachment with each load leg assembly thereby attaching the load leg assembly at two points to the main body 8. FIG. 2A is a detailed front view of the truss body (main 8) center portion of the Load Lifter Assembly as shown in FIG. 2 and throughout the remaining figures. FIG. 2B is a top view of the truss body plan view throughout.

FIG. 2C is a perspective view of the truss body of the Load Lifter Assembly 100 as shown throughout FIGS. 1-10C. As shown in FIG. 2C, the outer tube 35 of the master switch assembly 30 is positioned in the center of the main body 8 and affixed to the lower portion of the main body 8*c*.

Figure 6:
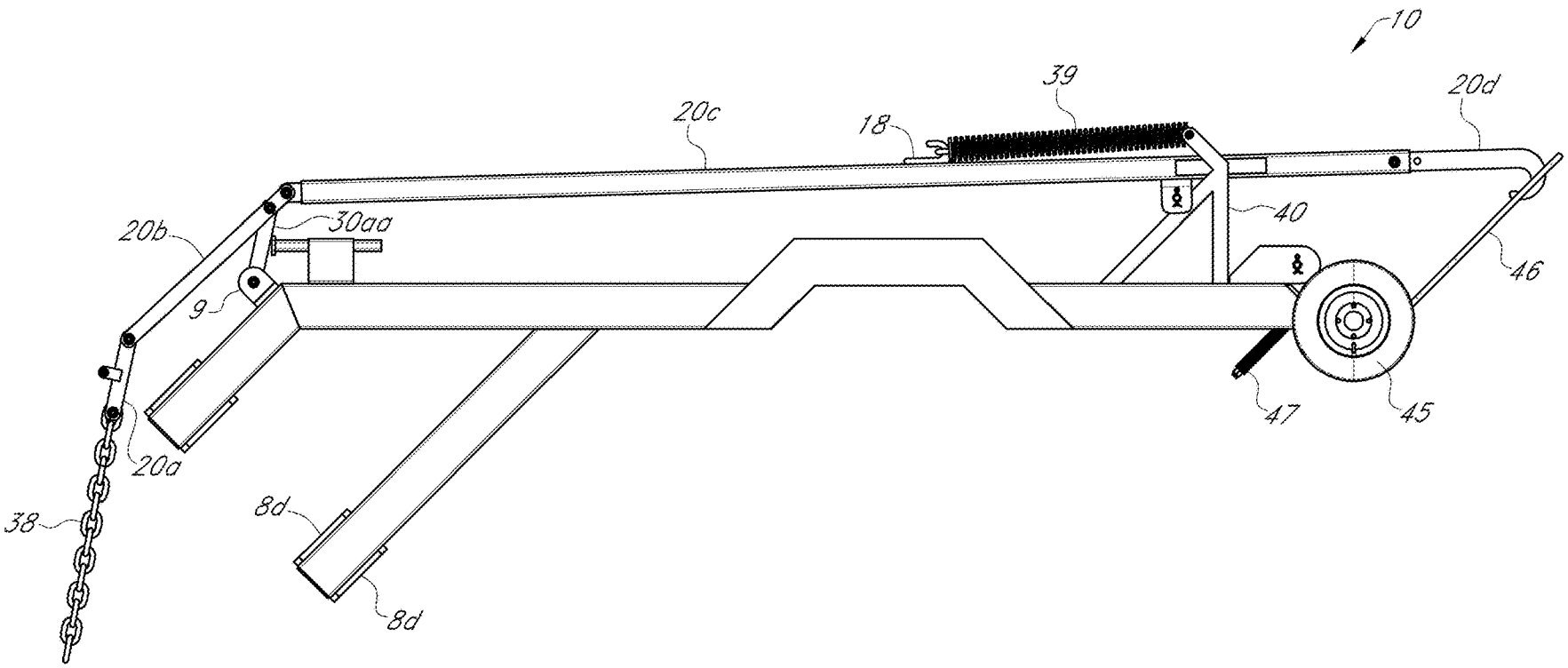
FIG. 6 is a detailed view of a 1st embodiment of the leg assembly.
Figure 6A:
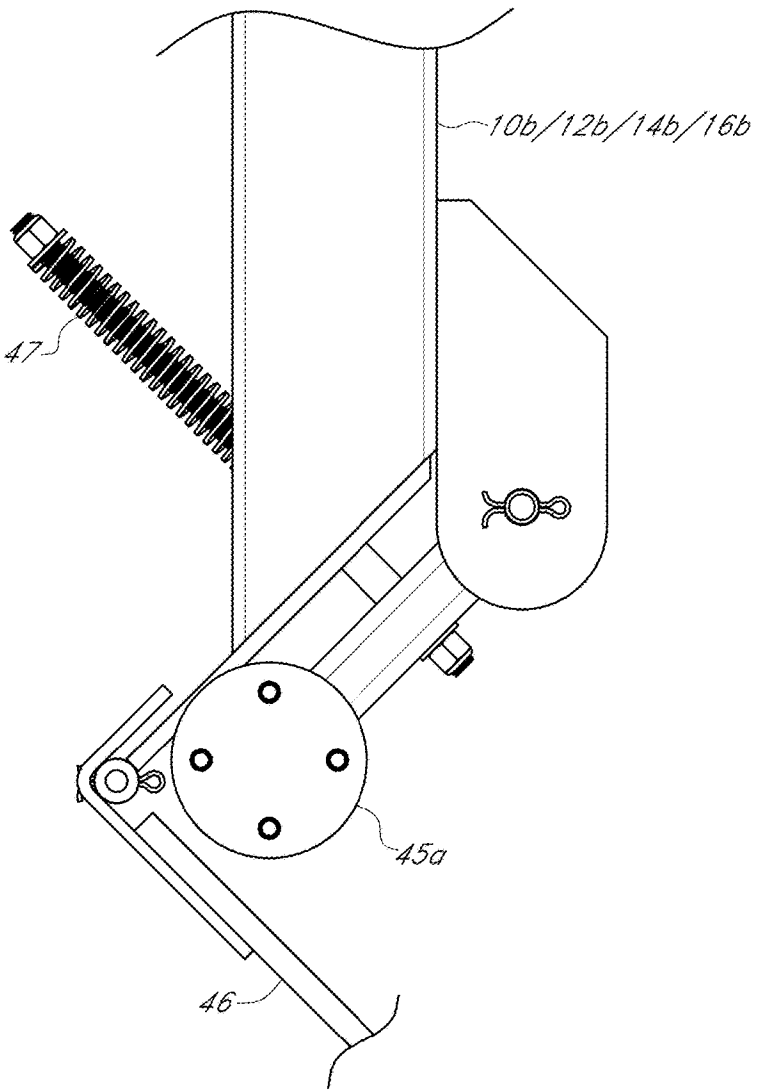
FIG. 6A is a detailed top view of a 1st embodiment of the wheel assembly.
Figure 6B:
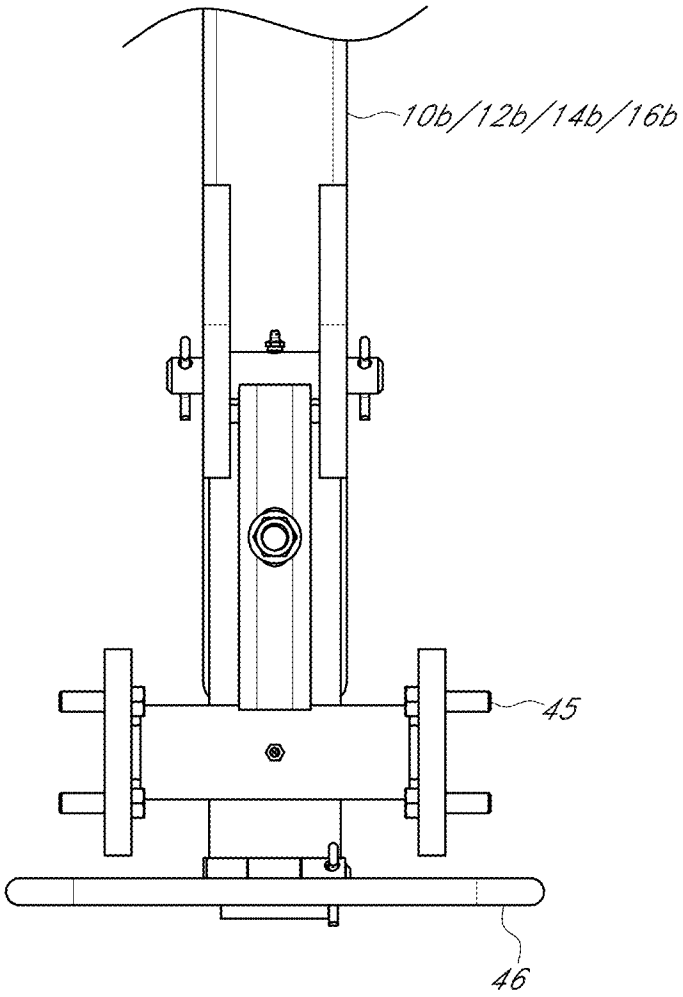
FIG. 6B is a detailed end view of a 1st embodiment of the wheel assembly.

As will be understood from this description and the figures, the load arm assemblies (20, 22, 24, 26) also attach to the main body truss 8 via a pair of mounting eyes 9 mounted upon the top portion of the main truss body 8 at each corner. (See FIGS. 2 and 2C) Each load arm assembly is comprised of three main segments. A first segment is configured with a pair of drop-down members 20*a* connected to a horizontal member 20*b*. The first end of each drop-down member 20*a* is then connected to the horizontal member 20*b*. The second end of the drop-down member connects to the mounting eyes 9 of the top portion of the main truss body 8. The second end of the horizontal member 20*b* is configured to attach the second segment of the load arm assembly which is a rod 20*c* which extends most of the length of the load leg assembly 10. The pivot action of the drop down members 20*a* attached to the main body truss 8 allows the horizontal members 20*b* to move generally horizontally yet affect generally vertical movement on the rod 20*c* which acts on the third segment of the load arm assemblies for lid engagement as will be discussed further herein as shown at FIGS. 6A-6B as guide assembly 40.

Figure 3:
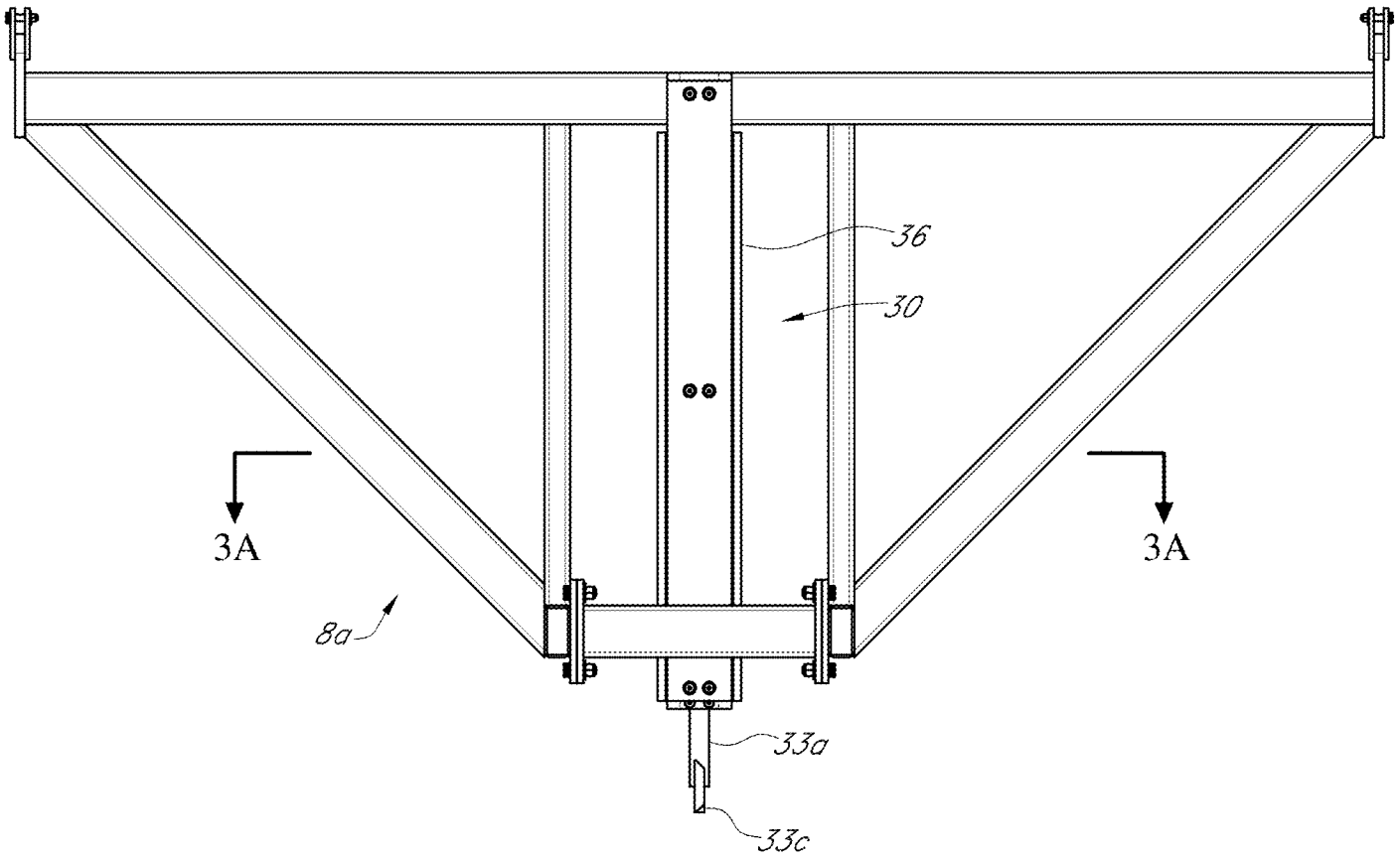
FIG. 3 is a detailed perspective view of a 1$^{st}$ embodiment of the upper works assembly.
Figure 3A:
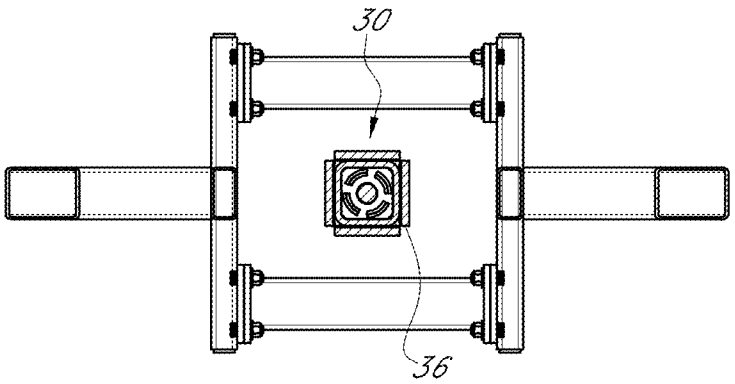
FIG. 3A is a detailed top view of a 1$^{st}$ embodiment of the upper switch assembly.
Figure 3B:
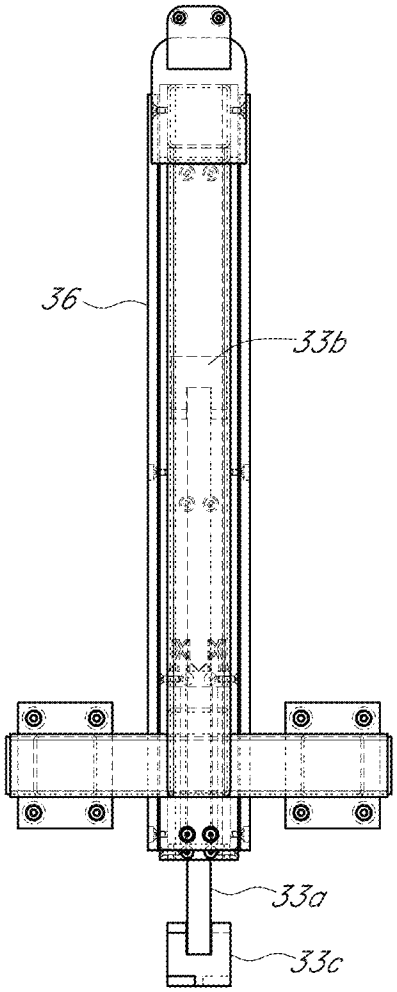
FIG. 3B is a side view of a 1$^{st}$ embodiment of the inner tube of the master switch assembly having a blade positioned at each end of the shaft all located in the inner tube.
Figure 3C:
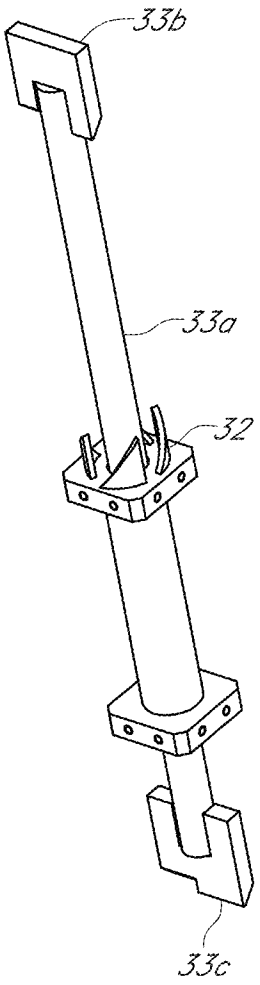
FIG. 3C is a detailed view of a 1$^{st}$ embodiment of the internal shaft of the switch mechanism.

FIG. 3 is a detailed perspective view of the upper portion 8*a* (upper assembly) or upper works assembly which comprises the upper portion of the load lifter assembly. As shown, the upper works assembly is configured as an inverted "V" on top of and interior of the rectangular shaped main (truss) body 8 which provides support and stabilization during operation. (See also FIG. 1C) FIG. 3A is a detailed section view of the upper works assembly. FIG. 3B is a detailed side view of the upper works assembly of FIG. 3. FIG. 3B is a side view of the inner tube 36 of the switch assembly 30 having a blade (33*b*/33*c*) positioned at each end of the shaft 33*a* all located in the inner tube 36 which is configured to ride up and down inside outer tube 36 which is affixed to the lower portion of the main frame assembly 8*c*.

As shown, a lubricated inner tube 36 is positioned in the center of the upper works assembly 8*a*. The upper works assembly is configured with a main support beam 8*d* which is positioned above the main body 8. The center portion 8*b* may be configured to hold and support a switch assembly 30 to control a load engagement system 32 and the lower portion configured for engagement with the loading legs which engage with a load, which is shown through-out the figures as a barge lid 1 but is not so limited or restricted as other applications may be suitable for the structure and methods disclosed and claimed. As through-out and particularly in FIGS. 1-1B, there are four loading legs 10, 12, 14 and 16. As shown in FIG. 1 each loading leg assembly (10, 12, 14, 16) has a first end (10*a*, 12*a*, 14*a*, 16*a*) and a second end (10*b*, 12*b*, 14*b*, 16*b*), with the first end configured for attachment to the lower portion of the main body 8*c*, the second end generally configured for engagement with the load. Each one of the four loading leg assemblies is further configured with a loading arm (20, 22, 24, 26, respectively) positioned proximate the loading leg and configured for actuation by the switch assembly 30 for engagement and disengagement with the load. As shown in FIGS. 1 and 6, the load arm assembly (20, 22, 24, 26) is positioned to extend the length of the load leg assembly (10, 12, 14, 16) from the top portion to the bottom portion where the load is engaged. See also FIG. 1A which is a side view of the Load Lifter Assembly 100 and FIG. 1B which is a top view of the Load Lifter Assembly as shown at FIG. 1.

Figure 4:
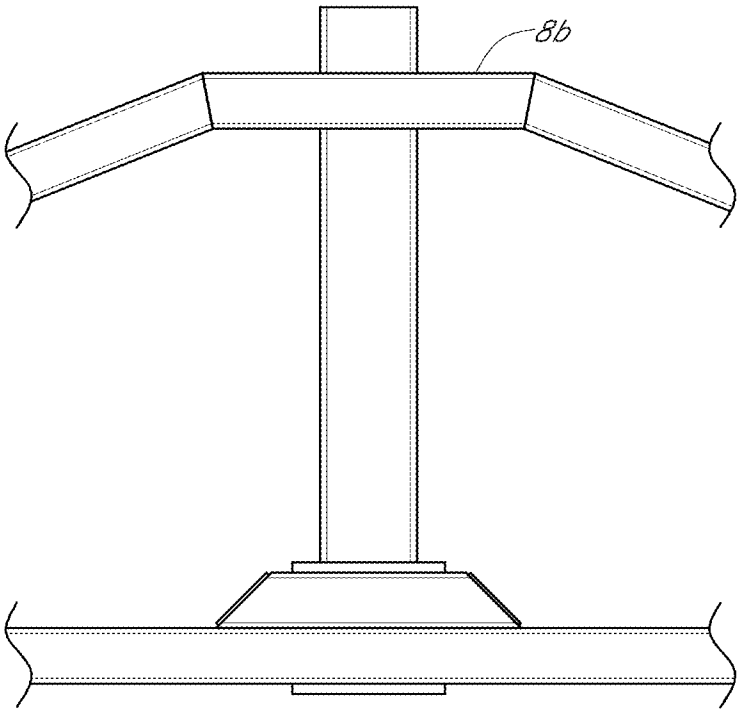
FIG. 4 is a side view of a 1$^{st}$ embodiment of the lifting mechanism of the Load Lifter Assembly.
Figure 4A:
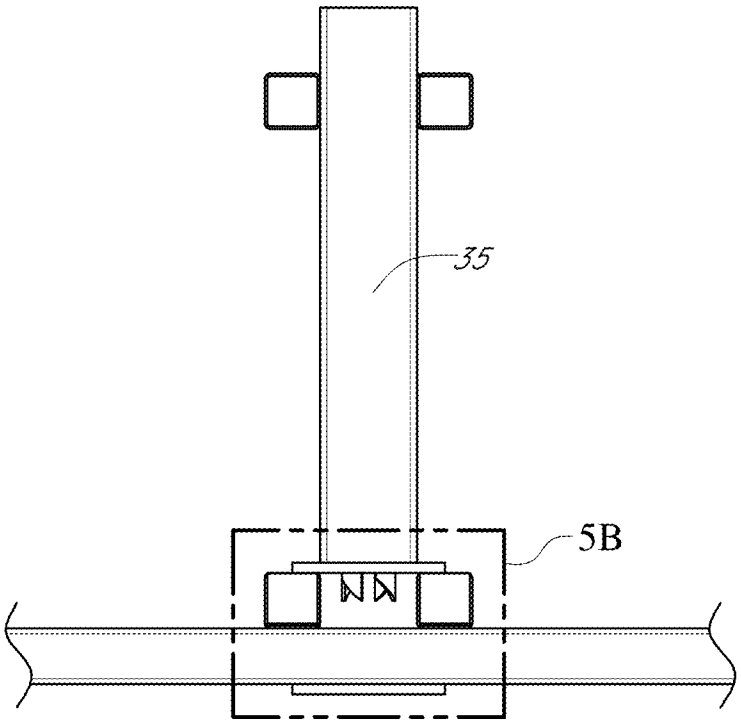
FIG. 4A is an end view of a 1$^{st}$ embodiment of the lifting mechanism of the Load Lifter Assembly.
Figure 5A:
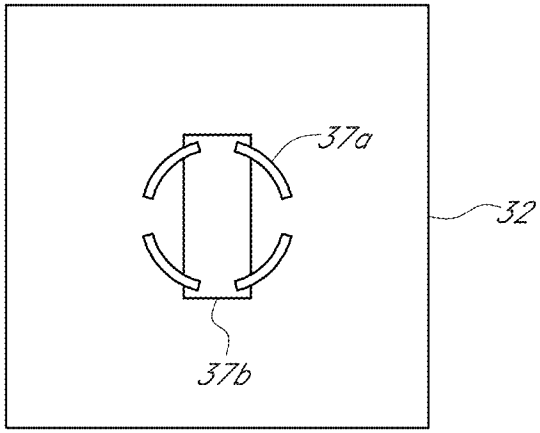
FIG. 5A is a detailed view of a 1$^{st}$ embodiment of the upper switch plate.
Figure 5B:
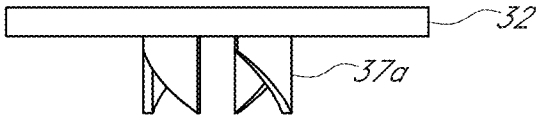
FIG. 5B is a detailed perspective view of a 1$^{st}$ embodiment of the upper switch plate and its operation.
Figure 5C:
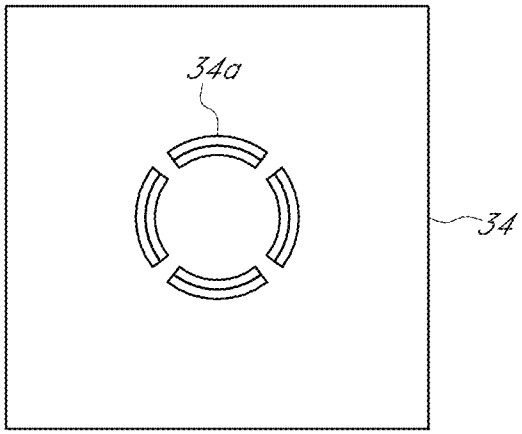
FIG. 5C is a detailed view of a 1st embodiment of the lower switch plate.
Figure 5D:
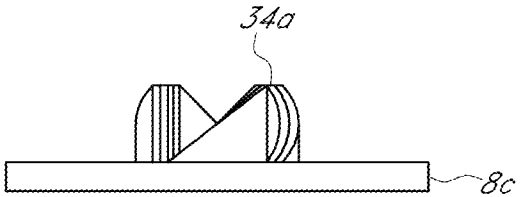
FIG. 5D is a detailed perspective view of a 1st embodiment of the lower switch plate and its operation.

In at least one embodiment of the switch assembly 30 disclosed herein, the switch assembly 30 is configured as a control system to allow the load lifter assembly 100 to allow an operator (not shown) using a lifting device 50, such as crane or hi-line, engaged with the load lifter assembly upper portion 8*a* to control engagement and disengagement with the load by lifting, releasing and lowering the load lifting assembly 100. Further as shown in at least FIG. 1 and FIG. 6, the leg assembly is configured with guide wheels 45 positioned at the lower end of the loading leg assembly (10, 12, 14, 16), each guide wheel 45 configured to engage with and be positioned on the top of the barge lid 1, between and in the depression 1*c* between the ridges 1*d*. See also FIG. 4 which is a side view of the lifting mechanism of the Load Lifter Assembly 100 and FIG. 4A is an end view of the lifting mechanism of the Load Lifter Assembly 100. FIG. 5A is a detailed view of the upper switch plate 32 of the switch assembly 30. FIG. 5B is a detailed perspective view of the upper switch plate 32 and its operation. FIG. 5C is a detailed view of the lower switch plate 34. FIG. 5D is a detailed perspective view of the lower switch plate 34 and its operation.

Figure 6C:
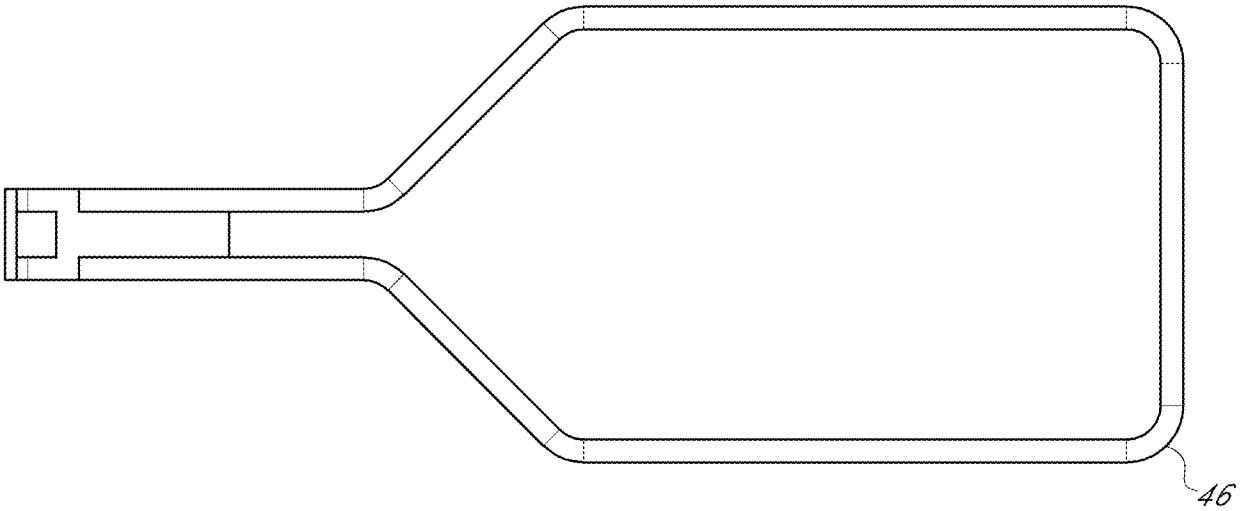
FIG. 6C is a top view of a 1st embodiment of the guide bar which attaches to the wheel assembly.

FIG. 6 is a detailed view of one loading leg assembly (10, 12, 14, 16), which is labeled as 10. One of ordinary skill will appreciate that each of the loading leg assemblies (12, 14 and 16) are similarly configured and operate in a similar manner. As shown, a chain 38 is attached to the end of the first drop down member 20*a* which is pivotably attached to the horizontal member first end 20*b*. The second end of the horizontal member 20*b* is pivotably attached to the rod 20*c* of the loading arm assembly 20. As previously shown, the first end of the second drop down member 20*aa* is pivotably attached to the structure of the loading leg assembly 10 and the second end attached to the horizontal member 20*b*. The second end of the horizontal member 20*b* is pivotably attached to the first end of the rod 20*c* which extends along the length of the leg assembly 10 to the guide assembly 40. FIG. 6A is a detailed top view of the wheel assembly 45 of the loading leg assembly 10 and FIG. 6B is a detailed end view of the wheel assembly 45. FIG. 6C is a top view of the guard 46 which attaches to the loading leg assembly 10. As shown throughout, the hooked end 20*d* is to be positioned in the guard during operation as discussed further herein. As shown the ends of the leg assemblies (10, 12, 14, 16) are configured with guide wheels 45 and guards 46. The load arm assemblies 10 are configured to operate upon and slide through the guide bar assembly 40 with the hooked end 20*d* positioned proximate the eyes 2 around the rim (edge) 1*a* of the barge lid 1. The wheels 45 work to hold the position of the deployed leg assemblies in relation to the barge lid 1. The guide bar assembly 40 are configured to stabilize the load arm assemblies 10 at the ends of the legs as the hooked end 20*d* of is positioned proximate the eyes 2 during engagement.

1st Embodiment Method of Operation

Figure 7:
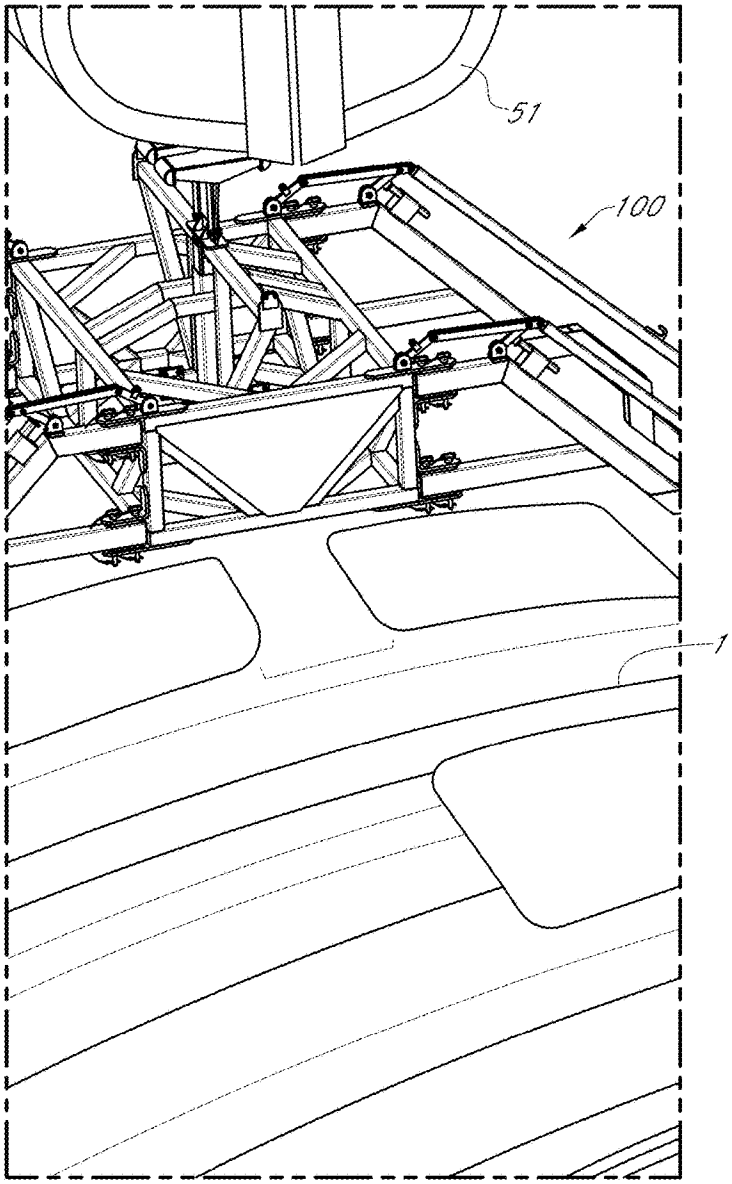
FIG. 7 illustrates the clamshell of the loader engaging the "T" of the load lifter assembly which is engaged with a barge lid.
Figure 8:
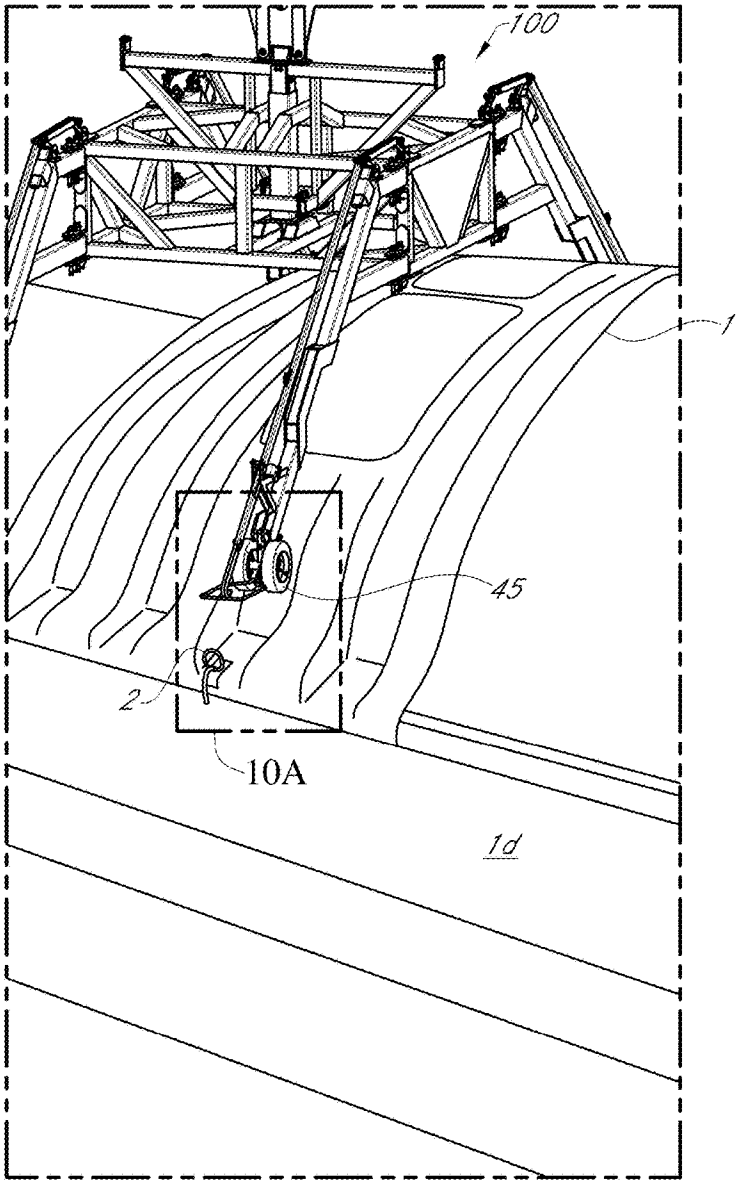
FIG. 8 illustrates a 1st embodiment of the load lifter assembly engaged with a barge lid during the lid removal process wherein the hooks have deployed to engage with the barge lid.

FIG. 7 illustrates the clamshell of the loader enclosing the engagement end 8*aa* configured as a "T" of the load lifter assembly 100 which is engaged with a barge lid 1. FIG. 8 illustrates the load lifter assembly 100 just prior to engagement with the barge lid 1 during the lid removal process wherein the hooks 2 of the barge lid 1 are to be engaged with the the guide assembly 40. FIG. 9 illustrates the guide wheels 45 engaged with a ridge 1*b* in the barge lid 1 setting the position of the loading legs 10 and thus the loading arm hooked end 20*d* positioned in the guide assembly 40 with the eye 2 of the barge lid 1 for securement.

Figure 10B:
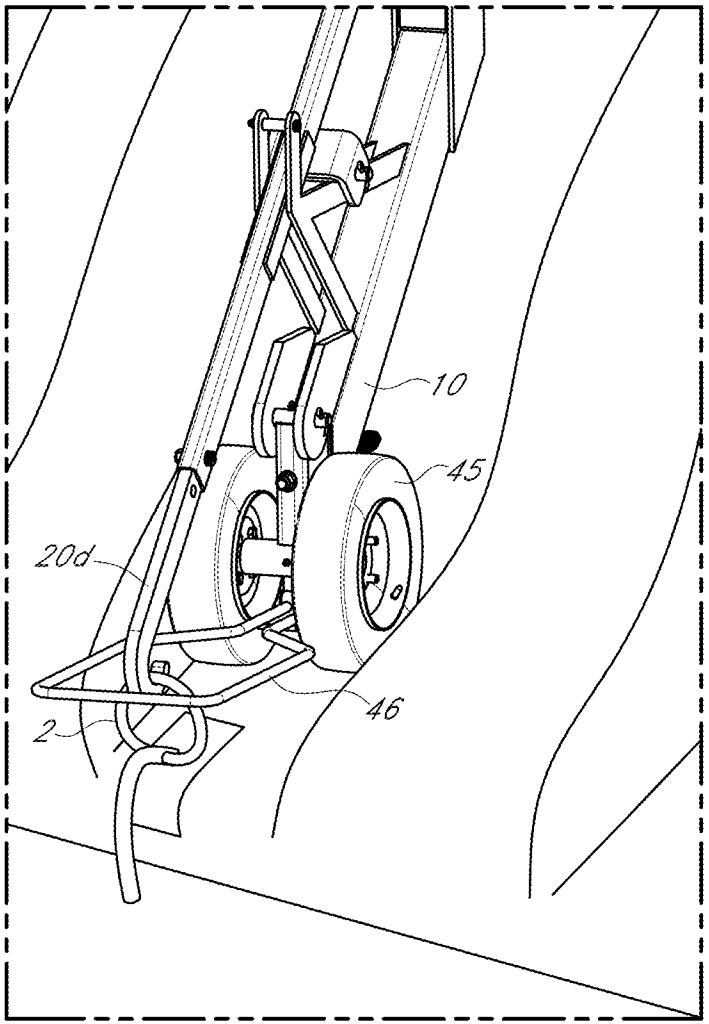
Figure 10C:
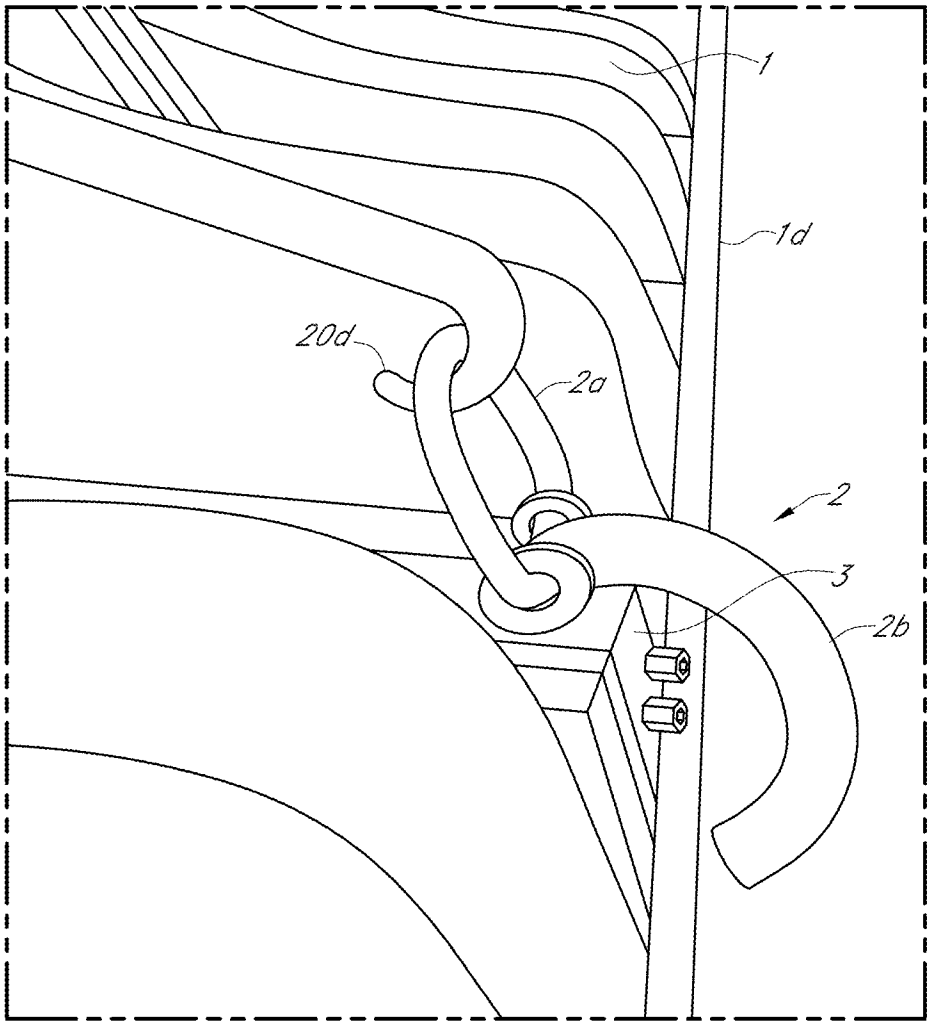
FIG. 10C is a detailed view of the barge lid latching eye (latch) moving to the unlocked position by actuation of the load arm hook end on the barge lid eye.

As shown, the load lifter assembly 100 has been allowed to rest against the barge lid 1 via the wheels 45, allowing release of the master switch 30 (hydrualic cylinder) which then acuates the guide assembly 40 via the chain 38 acting on the load arm assemblies 20 and the springs 39 therein. When the load lifter assembly 100 is then lifted, the guide assemblies 40 are engaged with the hooks or eyes 2 of the barge lid thus securing the barge lid 1 to the load lifter assembly 100. FIG. 10 illustrates the load lifter assembly 100 with hooks 2 fully engaged around the edge of the lid, the guide wheels 45 engaged in the recesses of the lid and the lid being removed from the barge. One of ordinary skill will appreciate that load lifter assembly 100 is configured to either operate to position and place the barge lid 1 upon the barge or remove the lid from the barge as well. FIG. 10B is a detailed view of the hook end of the load arm of FIG. 10 engaging with the eye of the barge lid to lock or unlock the lid to the barge. FIG. 10C is a detailed view of the barge lid eye (latch) moving to the unlocked position by actuation of the load arm hook end on the eye.

As shown in detail in FIGS. 11A-11B, conventional barge lids 1 include one or more latch members, referenced herein as hooks or lifting eyes 2 (hereinafter eye) which can be pivotally disposed on lid 1 and can be used to effectively latch and unlatch lid 1 to and from the barge Id. As shown, eye 2 in FIG. 11B is pivotally disposed on a bracket 3 attached to lid 1. Eye 2 is shown with a hook portion 2*a* and eyelet portion 2*b*. As the lifting eye 2 rotates with respect to lid 1, the hook portion 2*a* can rotate to engage or disengage the barge. As can be seen from FIG. 11B, the eye 2 can be in a normally latched position, with the hook portion 2*a* engaging barge lid 1 such that lid 1 remains latched or locked onto the barge 1*d*.

2nd Enabling Embodiment

DETAILED DESCRIPTION - TABLE OF ELEMENTS - 2ND EMBODIMENT

| Element Description | Element Number |
|---|---|
| Barge lid | 1 |
| Barge lid edge | la |
| Barge lid ridge | 1b |
| Barge lid depression | 1c |
| Hooks/eyes of barge lid | 2 |

-continued

DETAILED DESCRIPTION - TABLE OF ELEMENTS - 2ND EMBODIMENT

| Element Description | Element Number |
|---|---|
| Main body | 108 |
| Upper portion | 108a |
| Engagement end (T-shaped) | 108aa |
| Central portion | 108b |
| Lower portion | 108c |
| Welded plates | 108d |
| Eyes (main frame) | 109 |
| Loading legs - first | 110 |
| Loading legs -first - end | 110a |
| Loading legs - second | 112 |
| Loading legs - third | 114 |
| Loading legs - fourth | 116 |
| Load arm assembly (1st) | 120 |
| 1st/2nd Drop-down member | 120a/120aa |
| Horizontal member | 120b |
| Rod | 120c |
| End frame control mount | 120d |
| Hook assembly | 121 |
| Swing arm attachment portion | 121a |
| Engagement surface (curved) | 121b |
| Coupler (vertical) | 121c |
| Ear (axial) | 121d |
| Load arm assembly (2nd) | 122 |
| Load arm assembly (3rd) | 124 |
| Load arm assembly (4th) | 126 |
| Master switch assembly (hydraulic control system) | 130 |
| Upper switch plate | 132 |
| Shaft | 133a |
| Upper blade | 133b |
| Lower blade | 133c |
| Lower switch plate | 134 |
| Lower teeth | 134a |
| Outer tube | 135 |
| Inner tube | 136 |
| Upper wedges | 137a |
| Slot | 137b |
| Chain | 138 |
| Spring | 139 |
| Pin | 142 |
| Clevis | 143 |
| Guide wheels | 145 |
| Guide wheel assembly | 145a |
| End frame assembly | 150 |
| Support frame | 151 |
| Support frame bridge | 151a |
| Center of the support frame | 151b |
| Swing arms | 152 |
| First end | 152a |
| Second end | 152b |
| Diagonal control frame | 153 |
| Opening | 153a |
| Bottom | 153b |
| Ends | 153c |
| | 154 |
| Outrigger | 155 |
| Support frame lock | 156 |
| Support frame lock handle | 157 |
| Chain anchor | 158 |
| Cable (safety) | 159 |
| Chains (safety) | 160 |
| Load Lifter Assembly | 200 |

Figure 12:
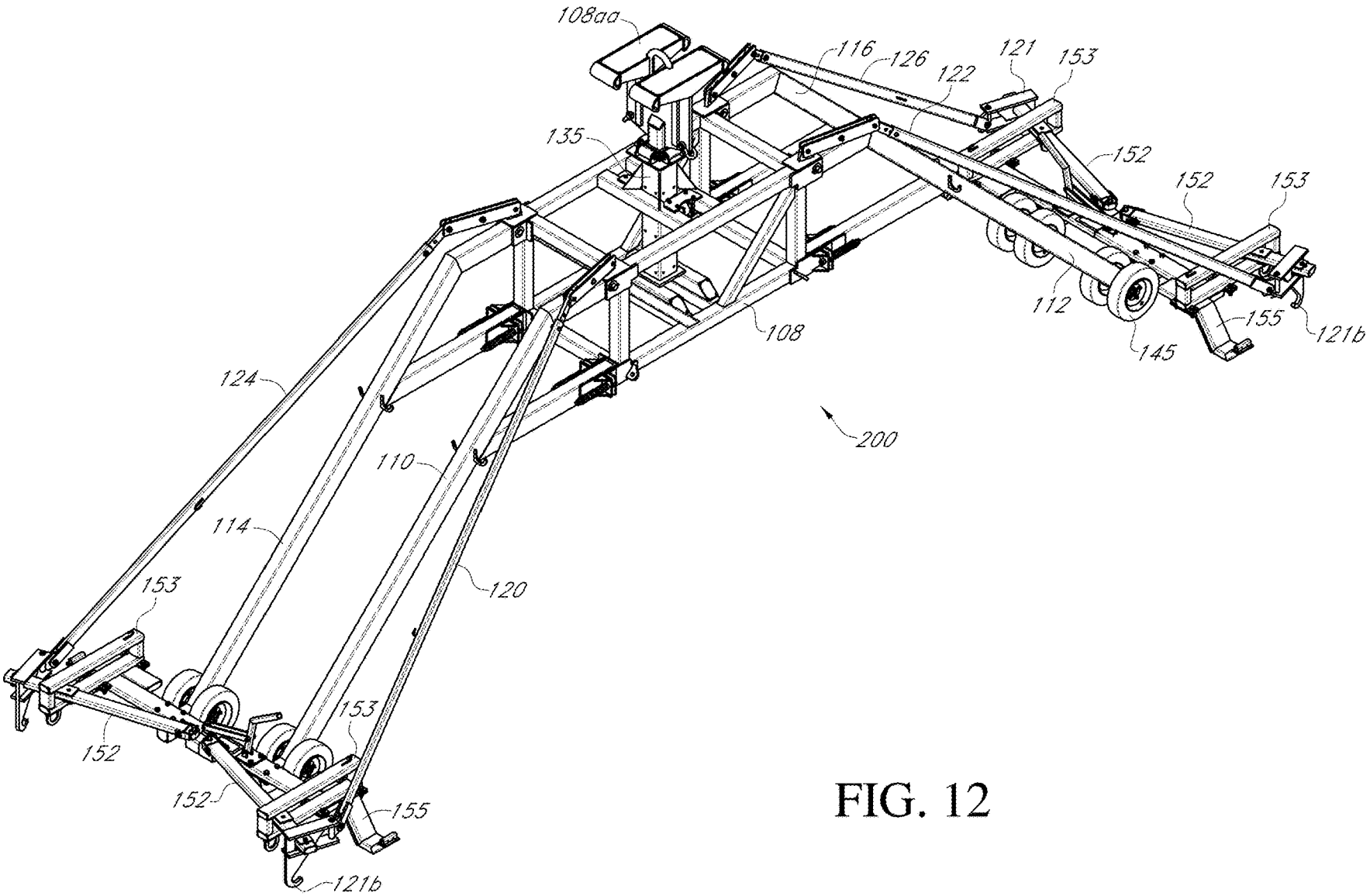
FIG. 12 is a perspective view of a 2nd embodiment of the Load Lifter Assembly disclosed herein along with detailed call outs for enablement of the present disclosure.

FIG. 12 is a perspective view of the 2nd Embodiment of the Load Lifter Assembly 200 disclosed herein along with detailed call outs for enablement of the present disclosure. Although presented as a "1st" and "2nd" embodiments of a Load Lifter Assembly 100/200, both embodiments are illustrative of the invention concepts capable of the various elements disclosed being combined and used as suitable for any particular deployment requiring engagement and lifting of a load.

As shown in FIG. 12, the Load Lifter Assembly 200 has four loading legs 110, 112, 114 and 116, respectively, for use in lifting operations of barge lids 1. The main (truss) body 108 has an upper portion 108*a* (upper assembly), a center portion 108*b* and a lower portion 108*c*. The upper portion 108*a* has an engagement end 108*aa* which is generally configured for engagement with the working end 51 (bucket, hook or clamshell as shown throughout) of a lifting device 50. As shown in the figures, it has a "T-shape" but is not so limited or restricted, as many other shapes may be suitable for a particular application.

FIG. 12 is a perspective view of a $2^{nd}$ embodiment of the Load Lifter Assembly 200 disclosed herein along with detailed call outs for enablement of the present disclosure.

Figure 12A:
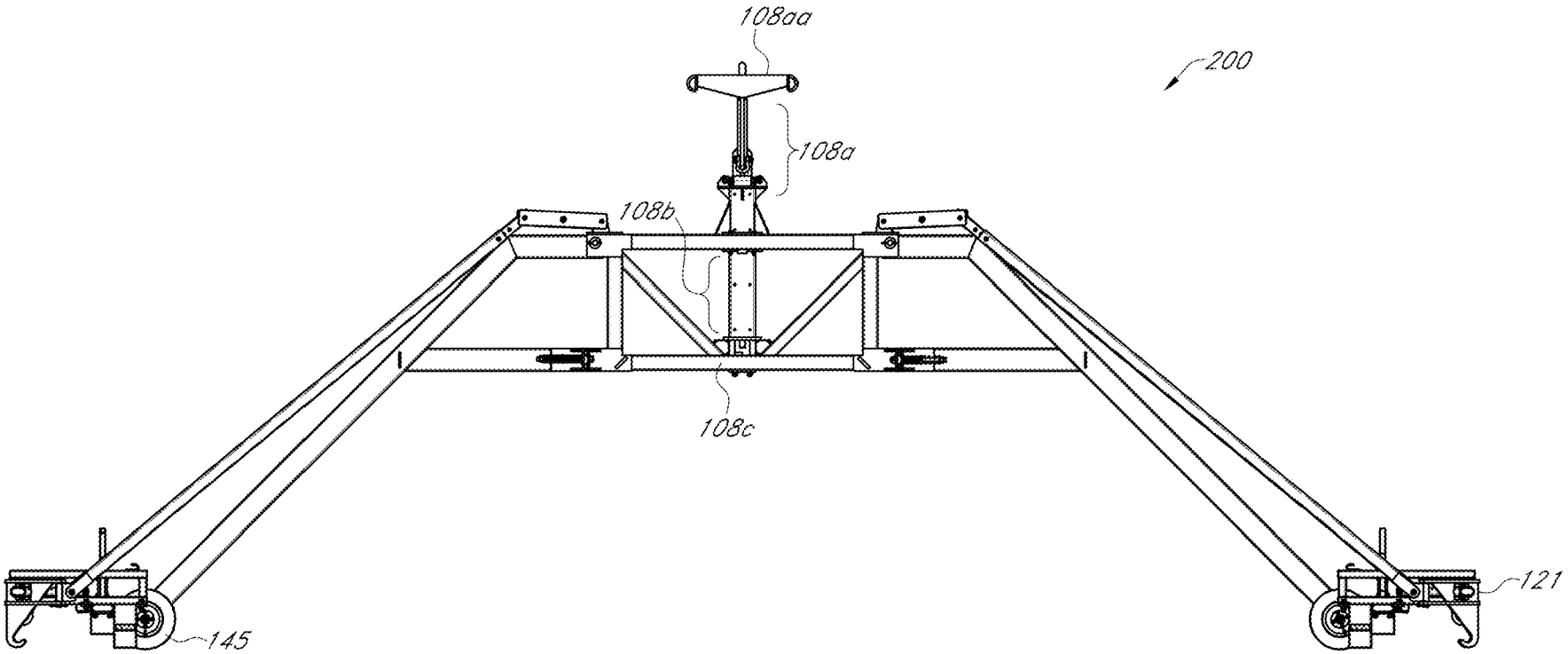
FIG. 12A is a side view of a 2nd Embodiment of the Load Lifter Assembly as shown in FIG. 12 and throughout the remaining figures.

FIG. 12A is a side view of a 2nd Embodiment of the Load Lifter Assembly 200 disclosed herein along with detailed call outs for enablement of the present disclosure.

Figure 12B:
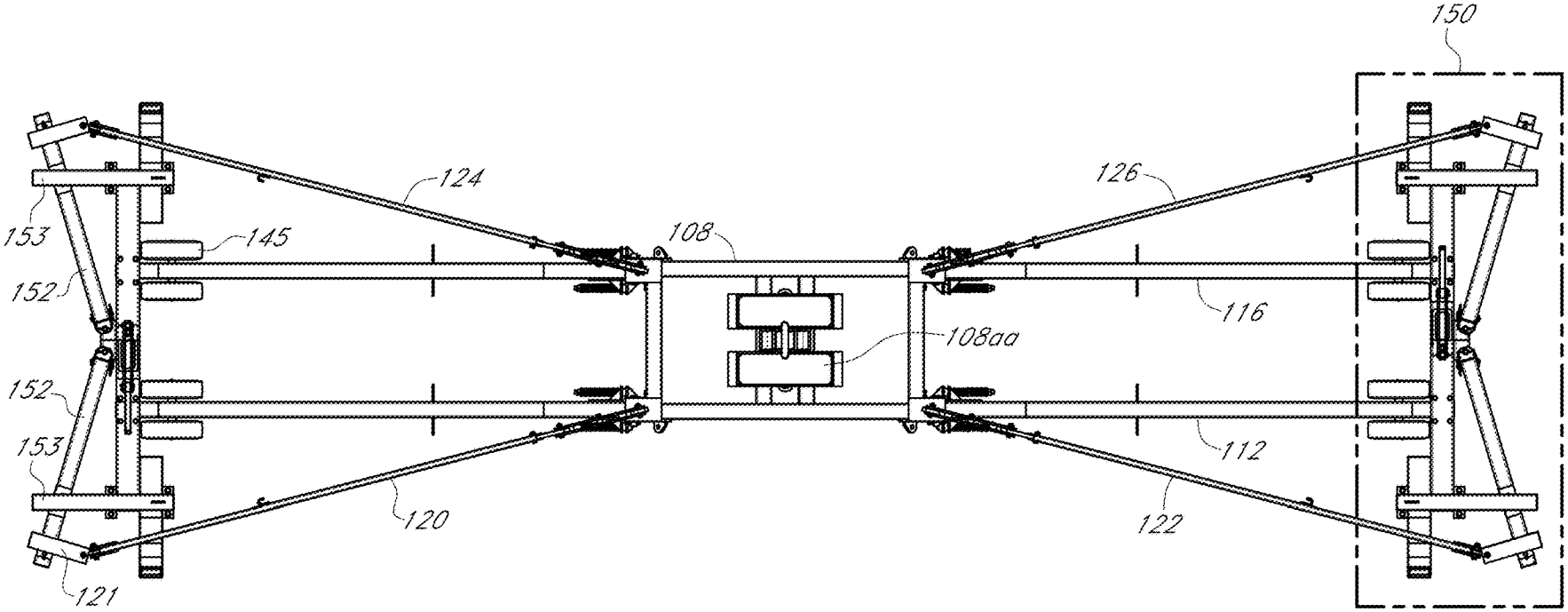
FIG. 12B is a top view of a 2nd Embodiment of the Load Lifter Assembly as shown in FIG. 12 and throughout the remaining figures.

FIG. 12B is a top view of a 2nd Embodiment of the Load Lifter Assembly 200 as shown at FIG. 12 along with detailed call outs for enablement of the present disclosure.

Figure 12C:
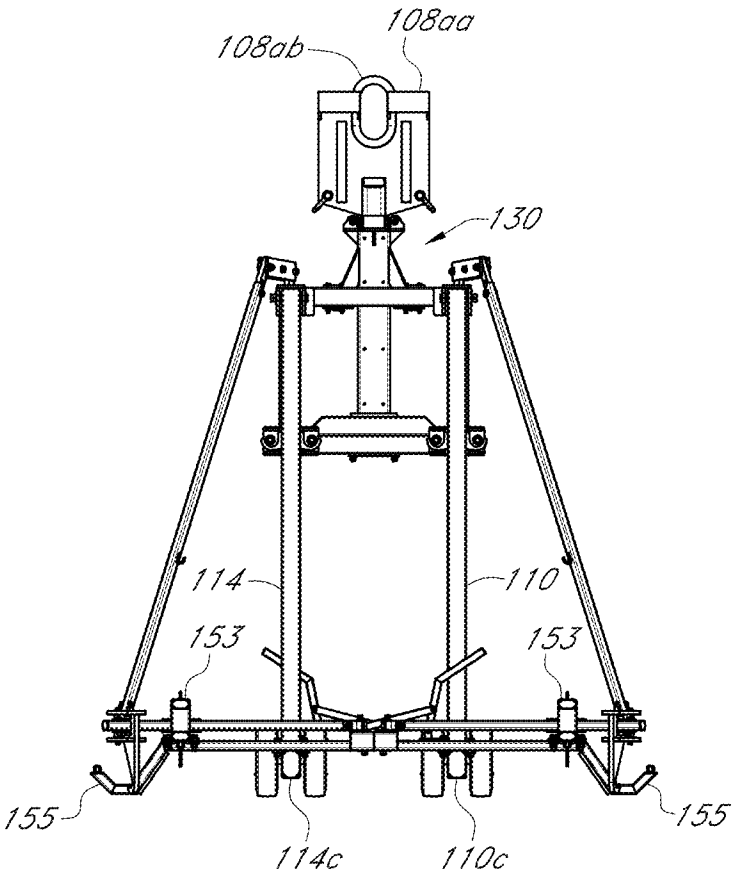
FIG. 12C is an end view of a 2nd Embodiment of the Load Lifter Assembly as shown at FIG. 12 and throughout the remaining figures.

FIG. 12C is an end view of a 2nd Embodiment of the Load Lifter Assembly 200.

Figure 12D:
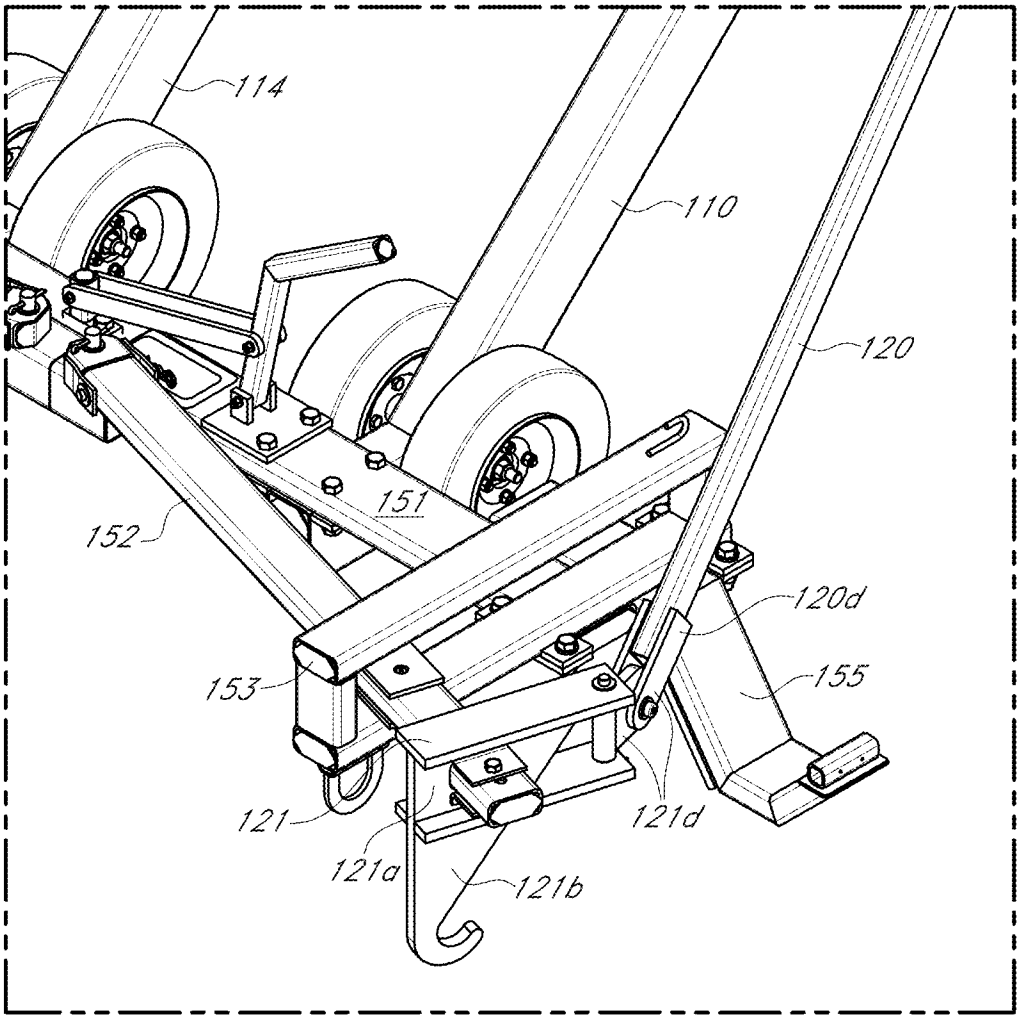
FIG. 12D is a detailed view of the end frame assembly of a 2nd Embodiment of the Load Lifter Assembly as shown in FIG. 12 and throughout the remaining figures.

FIG. 12D is a detailed perspective view of the end frame assembly 150 of a 2nd Embodiment of the Load Lifter assembly 200 along with detailed call outs for enablement of the present disclosure. For purposes of explanation, applicant describes just the left side end frame assembly 150 although of one of ordinary skill will appreciate that the end frame assembly 150 disclosed in FIG. 12D is for either the left side or right side and works with both the left loading legs (110, 114) as well as the right loading legs (112, 116), without limitation or restriction. Further, it will be appreciated that the end frame assembly 150 may be configured as a separate unit or a continuation of the loading legs (110, 114). As shown, the end frame assembly 150 rests upon the end of the loading legs frame (110*b*, 114*b*) which extends past the wheel assembly 145*a*. In one configuration the end assembly support frame 151 rests upon and is attached therein. As shown, the end assembly support frame 151 is configured to be extendable, i.e. it is comprised of two sections which may travel or slide back and forth in a lateral direction along an interiorly positioned slide (bridge) 151*a* positioned between the wheel assemblies 145*a*. It should be understood that the support frame 151 may also be configured to be non-extendable, i.e., as a single unitary support frame. As shown, the two sections may be locked together via the support frame lock 157 via locking arms 157*a* which are rotatably pinned at one end to the locking stub 151*b* and pinned to the support frame lock handle 157 at the other. As shown, the handle 157 is rotatably pinned to the support frame 151. In this configuration, the two sections may be locked together by manually moving the handle in a "cam over" type locking movement. One of ordinary skill will appreciate that other configurations may be used for the purpose of fixing the position of the two sections, without limitation or restriction. At each end of the support frame 151 is attached or positioned a diagonal control frame 153 which is shown, without limitation or restriction, as a rectangular box having an opening 153*a* therein. Although not shown, the diagonal control frame 153 could also be configured without a top side as a modified "U", without departure or restriction. As shown, the diagonal control frame 153 is generally perpendicular to the support frame 151 and parallel with the loading legs (110, 112, 114, 116). A pair of swing arms 152 are then rotatably pinned to either the support frame 151 or proximate to it at a first end 151*a*, which is generally between the wheel assemblies 145*a* and proximate the center of the support frame 151*b*. As shown, the swing arms 152 are rotatably pinned at the first end to a shelf like structure 151*d* attached to the support frame 151. The second end of the swing arm is positioned in and through the opening in the diagonal control frame and connected to a hook assembly 121 positioned therein. As shown, the upper portion of the hook assembly is configured with a coupler 121*c* positioned on a short rotatable shaft aligned in the vertical position which allows axial rotation of the coupler 121*c*. The coupler 121*c* has a short ear which is inserted into and affixed to the end of the loading arm configured as an end frame control mount (120*d*) (shown with apertures and pins) to allow rotation of the loading arm (120) in the vertical direction. The distance the swing arm may travel in relation to the support frame is then controlled or limited by the diagonal control frame by the inner sides at either end of the bottom side. Further, the top side of the diagonal control frame or restricts vertical movement of the swing arm for operational and safety purposes. The lower part of the hook assembly is the engagement portion and provides a curved surface (hook) to grab and engage with the inside of the eye (2*a*) of the prior art barge lid clamp 2 to roll or rotate it as illustrated in FIGS. 11A and 11B as well as in FIG. 10C for the $1^{st}$ embodiment of the load lift assembly 100. The $2^{nd}$ embodiment of the load lifter assembly 200 completes the same locking/unlocking operation of the barge lid clamp 2 using hook assembly 121 as the $1^{st}$ embodiment of the load lifter assembly 100 completed using hooked end 20*d*/22*d*/24*d*/26*d*.

Figure 13:
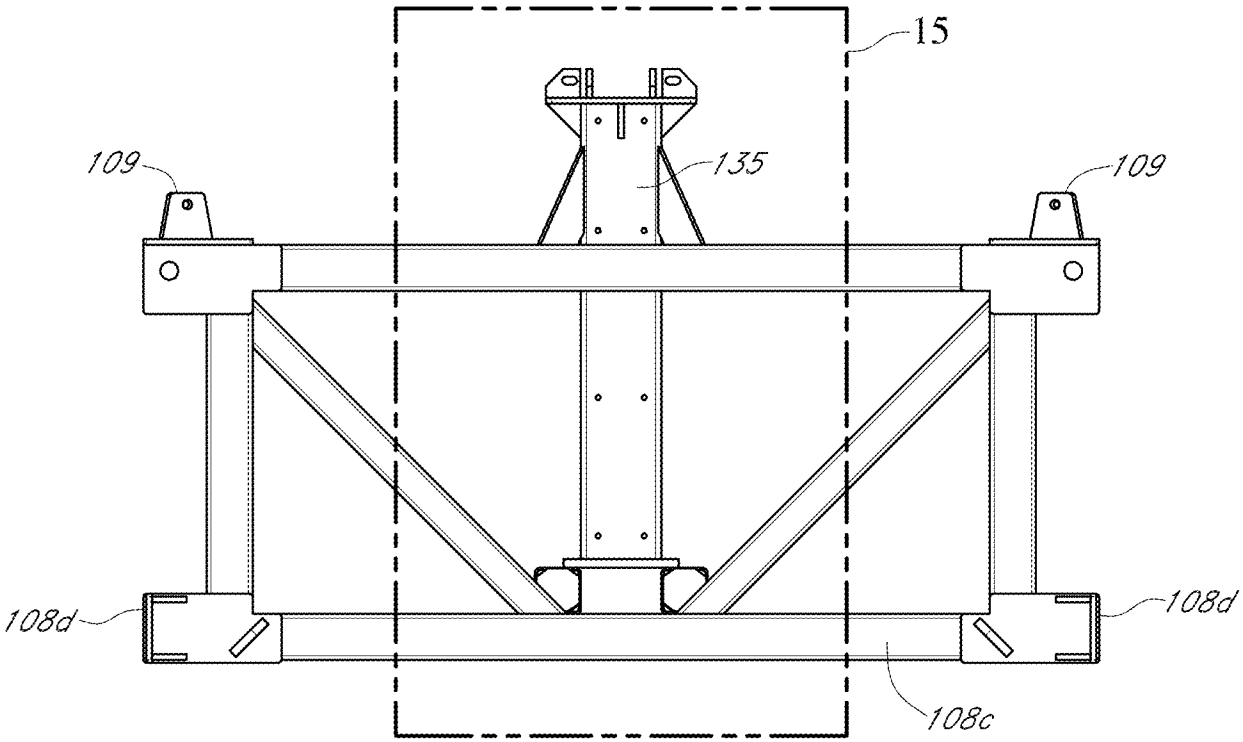
FIG. 13 is a detailed side view of the truss body of a 2nd Embodiment of the Load Lifter Assembly as shown in FIG. 12 and throughout the remaining figures.

FIG. 13 is a detailed side view of the truss body of a $2^{nd}$ Embodiment of the Load Lifter Assembly 200 as shown in FIG. 12 and throughout the remaining figures.

Figure 13A:
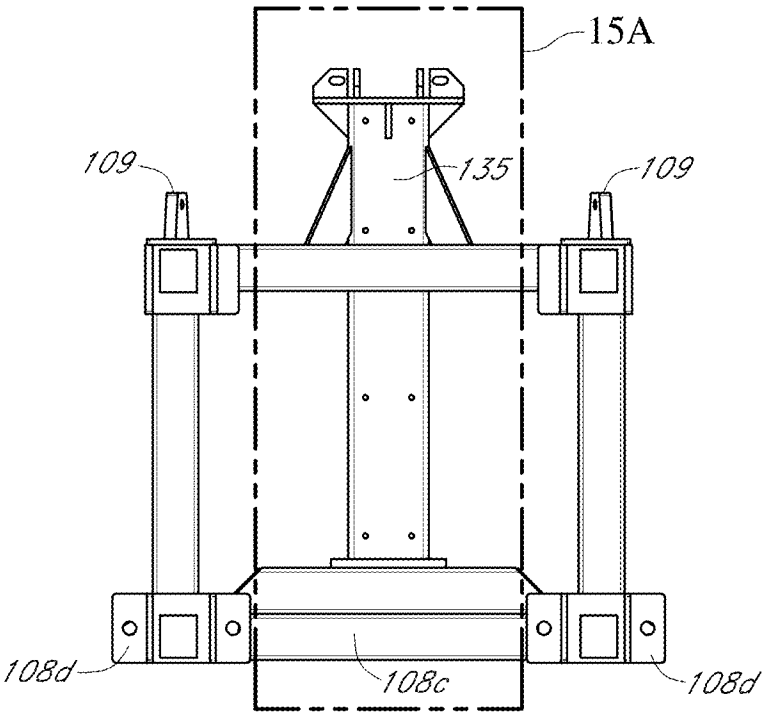
FIG. 13A is a detailed front view of the truss body center portion of a 2nd Embodiment of the Load Lifter Assembly as shown in FIG. 12 and throughout the remaining figures.

FIG. 13A is a detailed front view of the truss body center portion of a $2^{nd}$ Embodiment of the Load Lifter Assembly 200 as shown in FIG. 12 and throughout the remaining figures.

Figure 13B:
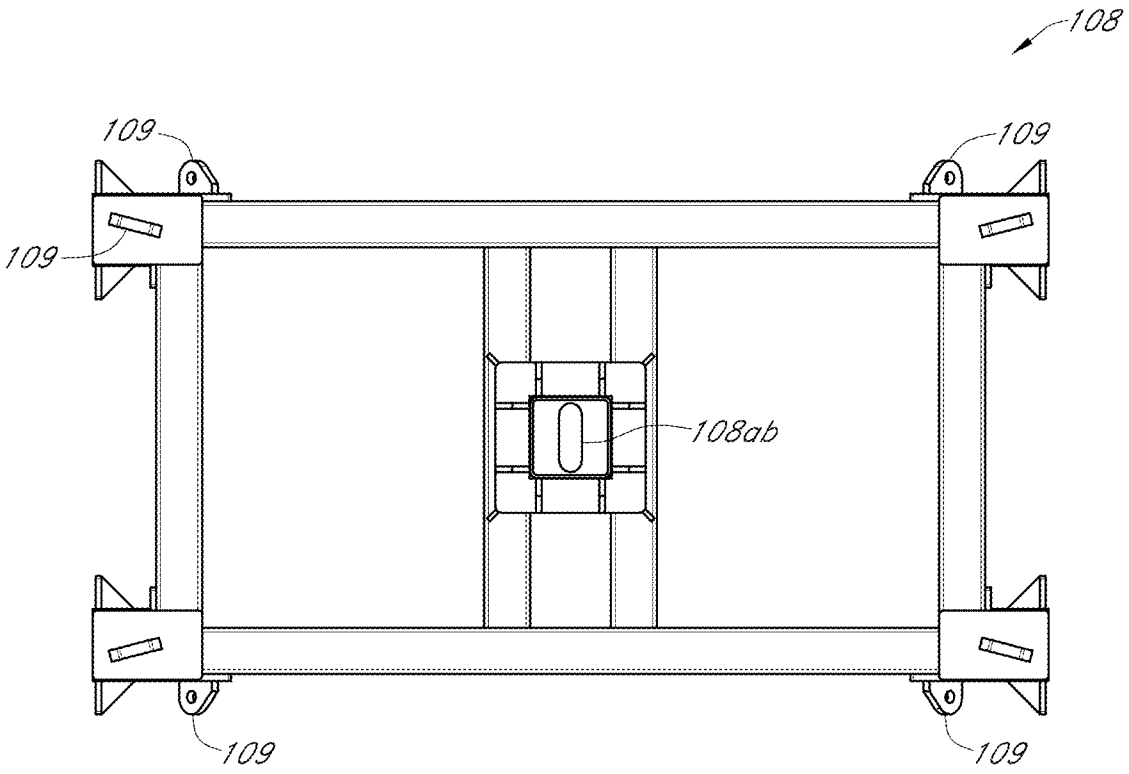
FIG. 13B is a top view of the truss body plan view of a 2nd Embodiment of the Load Lifter Assembly as shown in FIG. 12 and throughout the remaining figures.

FIG. 13B is a top view of the truss body plan view of a $2^{nd}$ Embodiment of the Load Lifter Assembly 200 as shown in FIG. 12 and throughout the remaining figures.

Figure 13C:
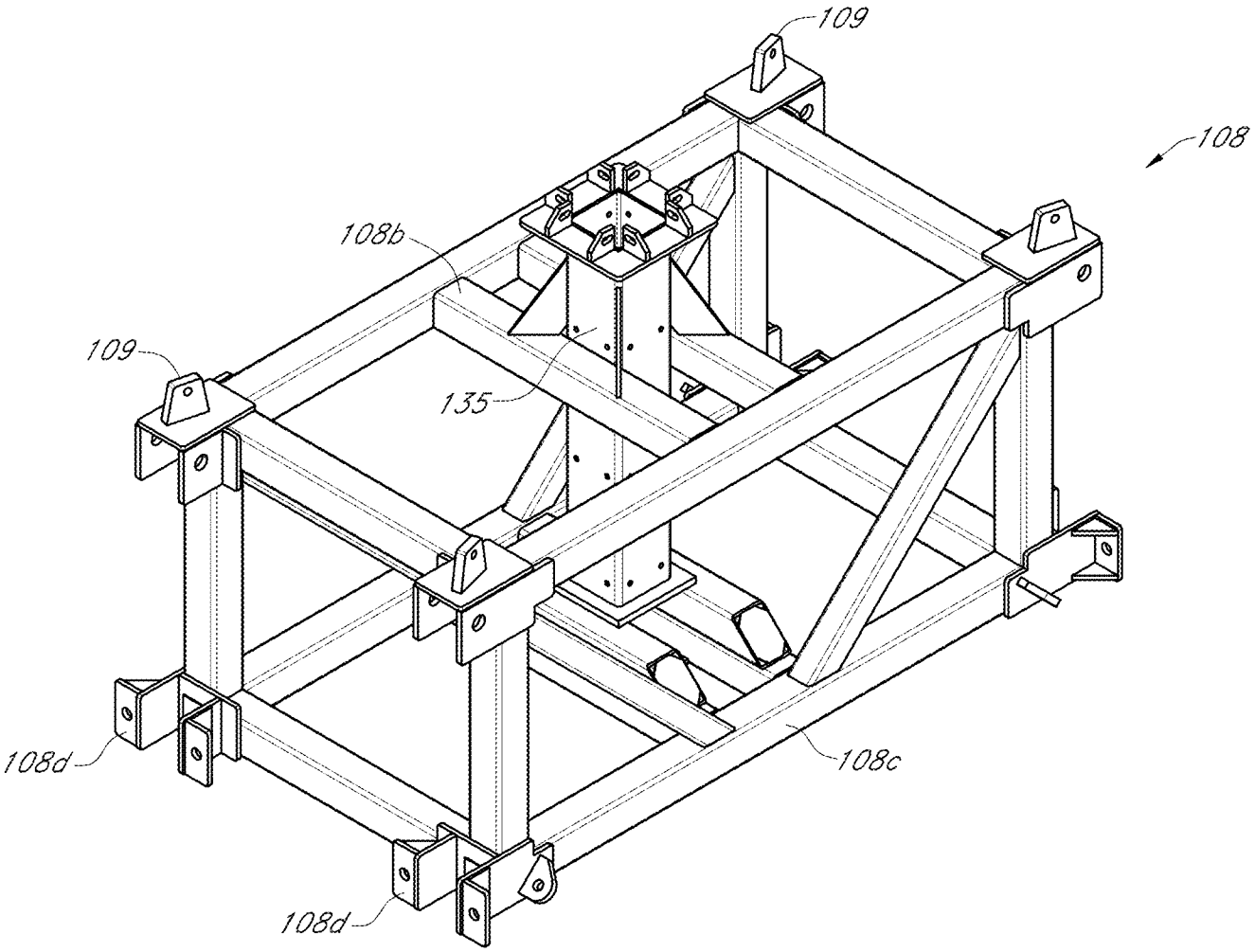
FIG. 13C is a perspective view of the truss body plan view of a 2nd Embodiment of the Load Lifter Assembly as shown in FIG. 12 and throughout the remaining figures.

FIG. 13C is a perspective view of the truss body plan view of a $2^{nd}$ Embodiment of the Load Lifter Assembly 200 as shown in FIG. 12 and throughout the remaining figures. As shown FIGS. 12-13C, the main (truss) body 108 of the $2^{nd}$ embodiment of the Load Lifter Assembly 200 is positioned between the loading leg assemblies (110, 112, 114 and 116) and is generally configured as a central rectangular structure that can support the load placed upon it by the lifting device, the load legs and the load and is further comprised of multiple cross members and supporting struts. (See also FIG. 13C)

Further, at each corner of the main body 108, on each side, plates 108*d* have been welded to allow attachment with each load leg assembly (110, 112, 114, 116) thereby attaching the load leg assembly at two points to the main body 108. See also FIG. 13C which provides a detailed truss body plan view. As will be understood from this description and the figures, the load arm assemblies (120, 122, 124, 126) also attach to the main body truss 108 via a pair of eyes 109 mounted upon the top portion of the main truss body 108 at each corner. Each load arm assembly has a first segment that is configured with a pair of drop-down members 120*a* connected to a horizontal member 120*b*. The first end of each drop-down member 120*a* is then connected to the horizontal member 120*b*. The second end of the drop-down member connects to the eyes 109 of the top portion of the main truss body 108. The second end of the horizontal member 120*b* is configured to attach the second segment of the load arm assembly which is a rod 120*c* which extends to the end frame assembly 140 and the hook assembly for engagement with the barge lid eye 2 which is colloquially referred to as a "sausage clamp" in the industry. The pivot action of the drop-down members 120*a* attached to the main body truss 108 allows the horizontal members 120*b* to move generally horizontally yet affect generally vertical movement on the rod 120*c* which acts on the hook assemblies 150 positioned at the second end of the load arm assemblies to move the hook assemblies back and forth for lid engagement as will be discussed further herein as shown at FIGS. 17-21.

Figure 16A:
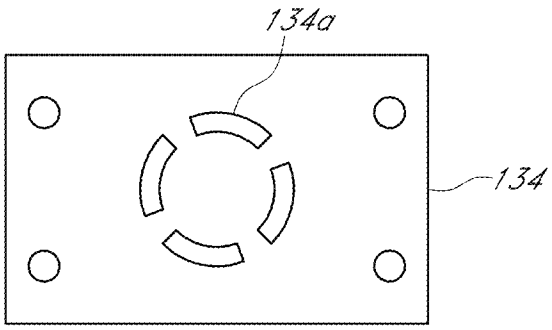
FIG. 16A is a detailed top view of the upper switch plate of a 2nd Embodiment of the Load Lifter Assembly as shown in FIG. 12 and throughout the remaining figures.

FIG. 16A is a detailed top view of the upper switch plate of a 2$^{nd}$ Embodiment of the Load Lifter Assembly as shown in FIG. 12 and throughout the remaining figures.

Figure 16B:
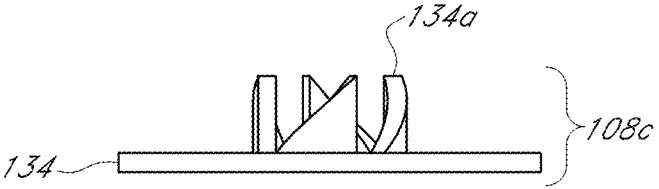
FIG. 16B is a detailed side view of the upper switch plate and its operation of a 2nd Embodiment of the Load Lifter Assembly as shown in FIG. 12 and throughout the remaining figures.

FIG. 16B is a detailed side view of the upper switch plate and its operation of a 2$^{nd}$ Embodiment of the Load Lifter Assembly as shown in FIG. 12 and throughout the remaining figures.

Figure 17:
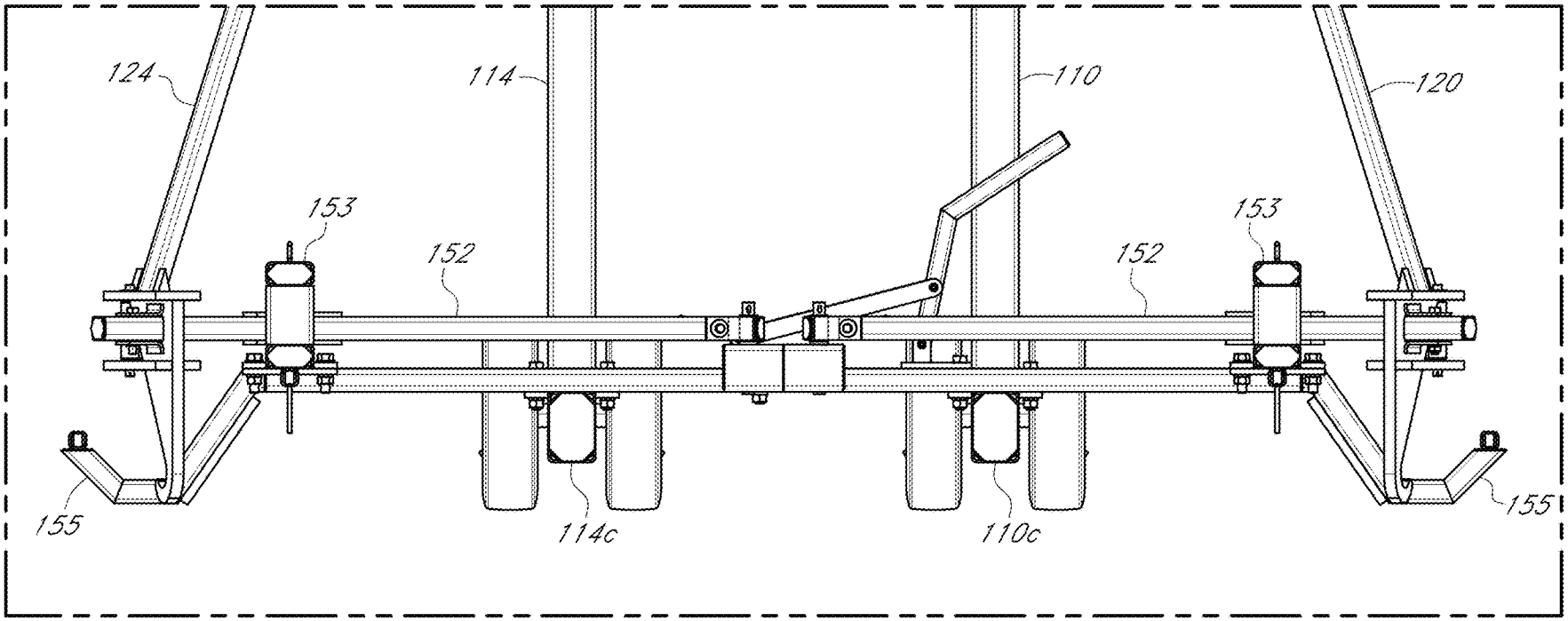
FIG. 17 is a detailed end view of the wheel assembly of a 2nd Embodiment of the Load Lifter Assembly as shown in FIG. 12 and throughout the remaining figures.
Figure 18:
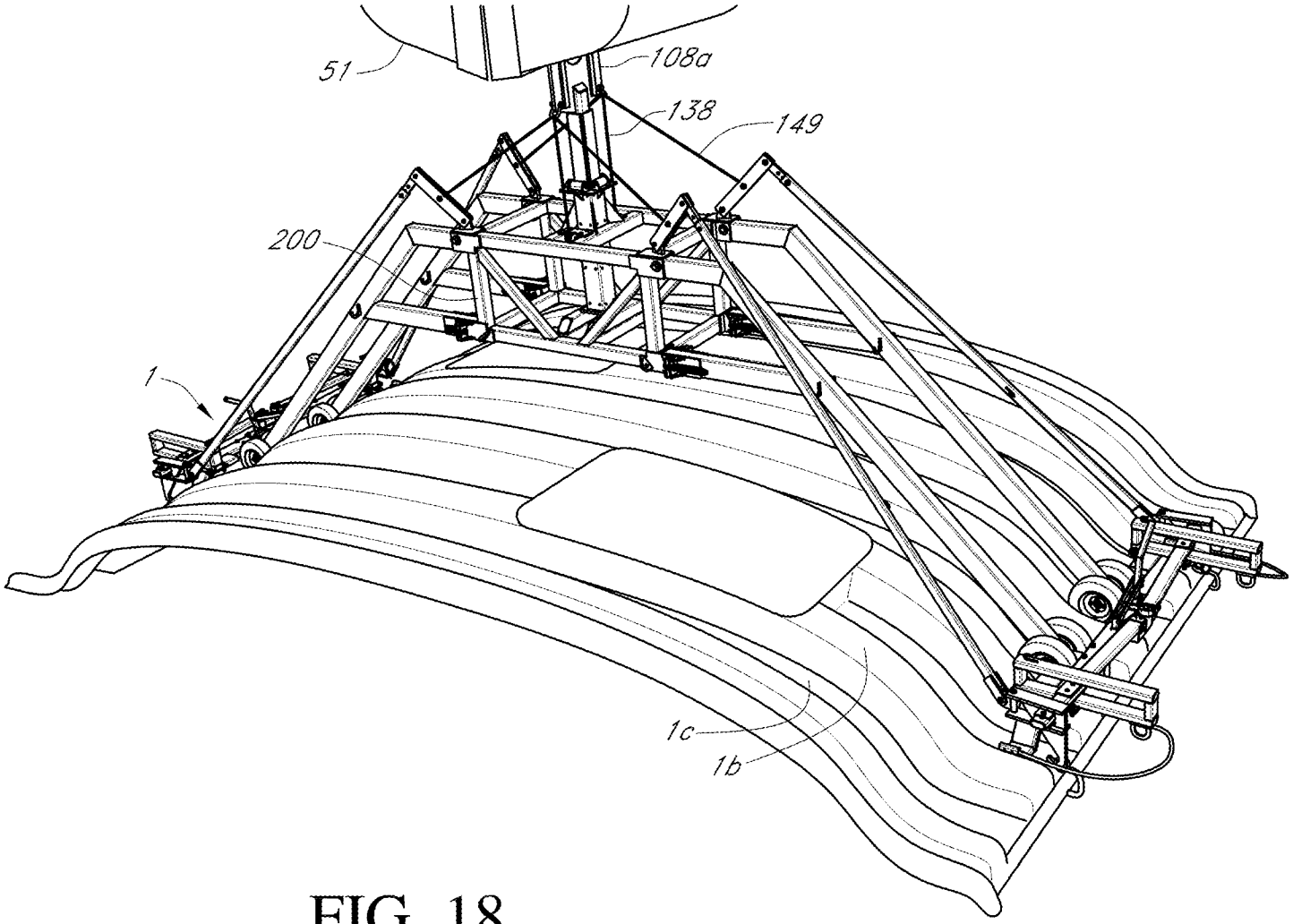
FIG. 18 illustrates the clamshell of the loader engaging the "T" of the load lifter assembly which is engaged with a barge lid of a 2nd Embodiment of the Load Lifter Assembly as shown in FIG. 12 and throughout the remaining figures.

FIG. 17 is a detailed view of the load lifting leg assembly of the 2$^{nd}$ Embodiment of the Load Lifter Assembly and FIG. 16A is a detailed side view of the wheel assembly of the hook assembly of the 2$^{nd}$ Embodiment of the Load Lifter Assembly. FIG. 16 is a detailed view of one loading leg assembly (110, 112, 114, 116), which is labeled as 110. One of ordinary skill will appreciate that each of the loading leg assemblies (110, 112, 114 and 116) are similarly configured and operate in a similar manner. As shown in FIG. 18, a wire rope sling 149 is attached to the end of the first drop down member 120*a* which is pivotably attached to the horizontal member first end 120*b*. The second end of the horizontal member 120*b* is pivotably attached to the rod 120*c* of the loading arm assembly 120. The second end of the horizontal member 120*b* is pivotably attached to the first end of the rod 120*c* which extends to the end frame assembly 140.

Figure 17A:
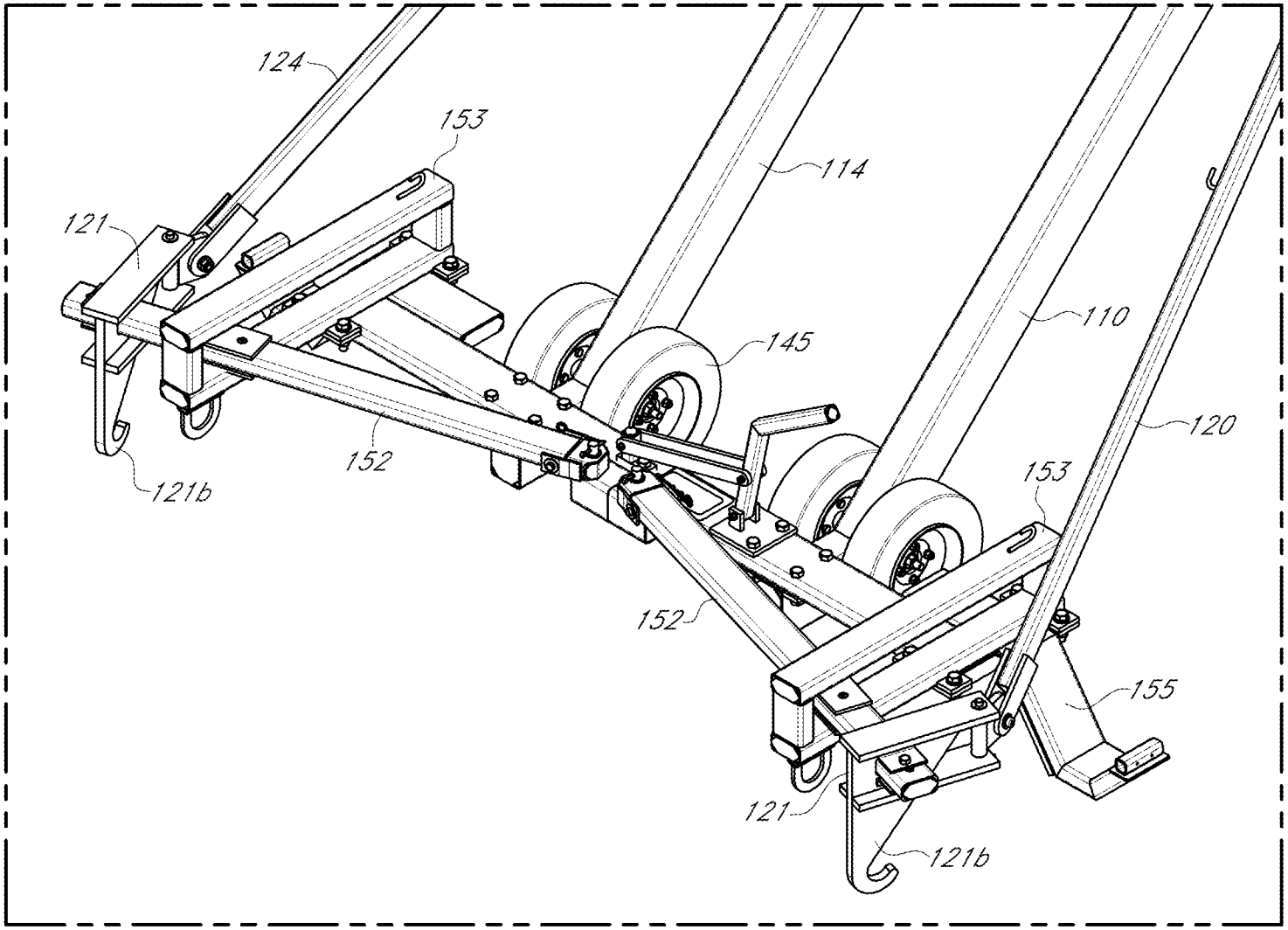
FIG. 17A is a perspective view of the end frame assembly of a 2nd Embodiment of the Load Lifter Assembly as shown in FIG. 12 and throughout the remaining figures.
Figure 19:
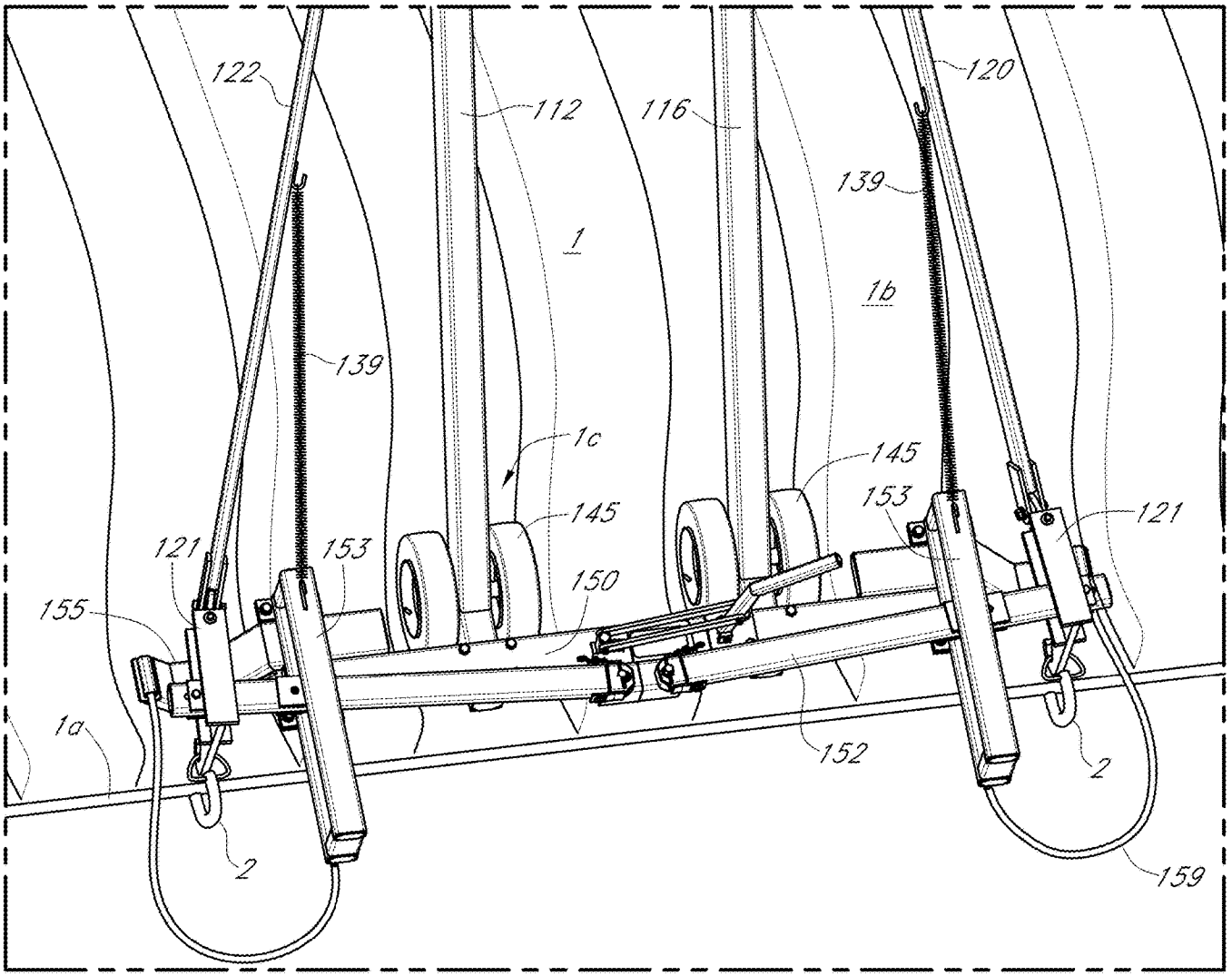
FIG. 19 is a top view of the end frame assembly with the wheels resting on the barge lid and the hook of FIG. 17-17A of a 2nd Embodiment of the Load Lifter Assembly as shown in FIG. 12 and throughout the remaining figures.
Figure 20:
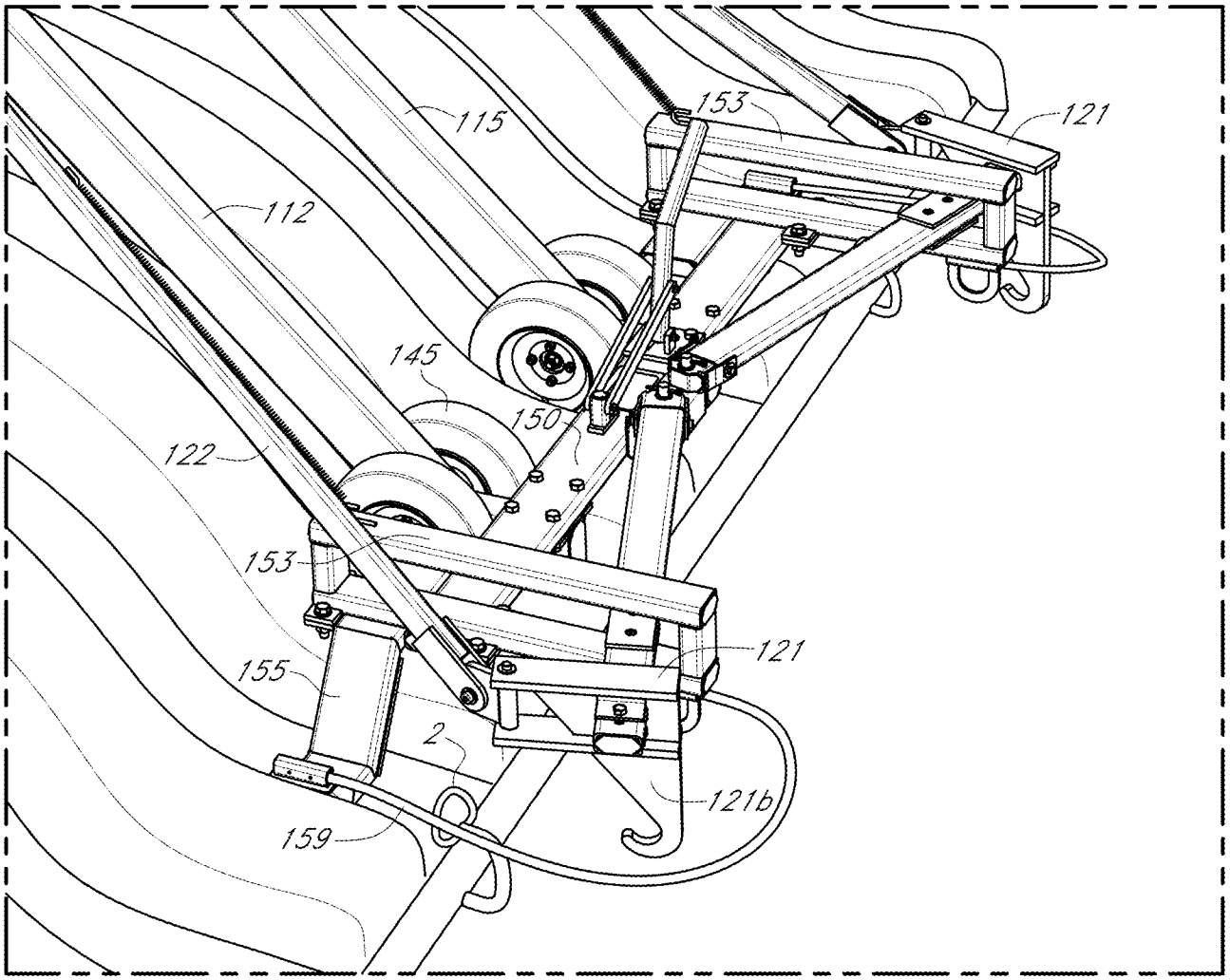
FIG. 20 is a perspective view illustrating the wheels engaged between the ridges in the barge lid with the hook ready for deployment and engagement with the barge lid for a 2nd Embodiment of the Load Lifter Assembly as shown in FIG. 12 and throughout the remaining figures.

FIG. 17A is a detailed perspective view of the end frame assembly 150 and FIG. 17 is a detailed front view of the end frame assembly 150. Unlike the 1$^{st}$ embodiment, the 2$^{nd}$ embodiment load arm assemblies do not follow along the length of the loading leg assemblies but instead diverge from the 2$^{nd}$ end of the loading leg assemblies. See top view FIG. 12B. As shown the ends of the loading leg assemblies 110 are configured with guide wheels 145 which are positioned interior of the ends of the arm assemblies (120, 122, 124, 126). The second end of the load arm assemblies 120 are configured to operate upon and engage the hooks or eyes 2 around the rim (edge) la of the barge lid 1. The wheels 145 work to position support and stabilize the end frame assembly upon the lid 1 and proximate the hooks or eyes 2. FIGS. 18-20 illustrate a working model of the 2$^{nd}$ embodiment of the load lifter assembly 200 disclosed at FIGS. 12-17 engaging with a barge lid 1 during the barge lid 1 removal process wherein the hook engagement surface 121*b* of the hook assembly 121 may be deployed to engage with the barge lid hooks 2. FIG. 18 illustrates a perspective view (left side) with the wheels 145 engaged with ridges 1*b* in the barge lid with the loading arms extending out from the loading legs to position the load lifter assembly 200 for hook deployment and engagement with the barge lid 1. FIG. 17A is a front view of the perspective view of FIG. 17A.

FIG. 17A is a perspective view of the end frame assembly of a 2$^{nd}$ Embodiment of the Load Lifter Assembly 200 providing additional detail of the spanned horizontal catch mechanism positioned between the loading legs (110, 112, 114, 116). This figure shows how the end frame assembly 150 sits down in the next recess out from the guide tires 145. The small bases (outriggers 155) on each end of the end frame assembly 150 rest in the void and provide the extra stability.

2$^{nd}$ Embodiment Method of Operation

As shown in FIGS. 11-21, the main body 108 is comprised of a box type frame 3'4" wide by 3' tall by 6' long. The loading legs (110, 112, 114, 116) attach to the frame of the main body with a horizontal pin at the top and die springs 139 at the bottom allowing the loading legs to flex. This provides some cushion when the load lifter assembly 200 is set down a little bit aggressively. Each loading leg has a set of wheels (145) at the end opposite the main body 108. These wheels (145) fit into the recesses of the fiberglass cover (1*c*) and line the unit up with the lifting rings 2 (which will be referred to as sausage clamps as located on the barge lid 1). The top of the lifter 108*a* has a "T" shaped head 108*aa* with an oval ring in the center 108*ab*. This allows a hydraulic clambucket 51 from a material handler, a rotator, or a conventional crane hook to lift the load lifter assembly (100 or 200). Unlike the 1$^{st}$ embodiment of the Load Lifter Assembly 100, there is a set of linkages 119 pinned on each of the four corners of the 2$^{nd}$ embodiment of the Load Lifter Assembly 200. A galvanized wire rope 149 with eyes on each end then connects the head to the center of the linkage. The four (4) loading arm assemblies (120, 122, 124, 126) are pinned to the top of the linkage 120. The hooks 121 that grab the sausage clamps 2 are pinned to the lower end of the loading arm assemblies. The "T" head 108*aa* is connected to a square tube 136 to form the upper portion 108*a*. This inner tube 136 slides vertically inside a larger square outer tube 135. As the "T" head is raised, the loading arm assemblies are pulled in to engage the hook assemblies 121 with the hooks 2 (sausage clamps). See FIGS. 12-12D.

As illustrated by FIGS. 12C-12D and FIGS. 17-17A, the end frame assembly 150 is located at the base of the loading leg assemblies (110, 112, 114, 116). This end frame assembly 150 attaches under the wheels 145 on the loading leg assemblies. It extends out to line up in the next recess (1*c*) out on the barge cover in each direction. It acts as a stabilizer and gives the load lifter assembly 200 the same footprint as the original load lifter assembly 100. The swing arms 152 are hinged towards the center of the end frame assembly 150 and the hook assemblies 121 are pinned to the outer ends of the swing arms 152.

Figure 14:
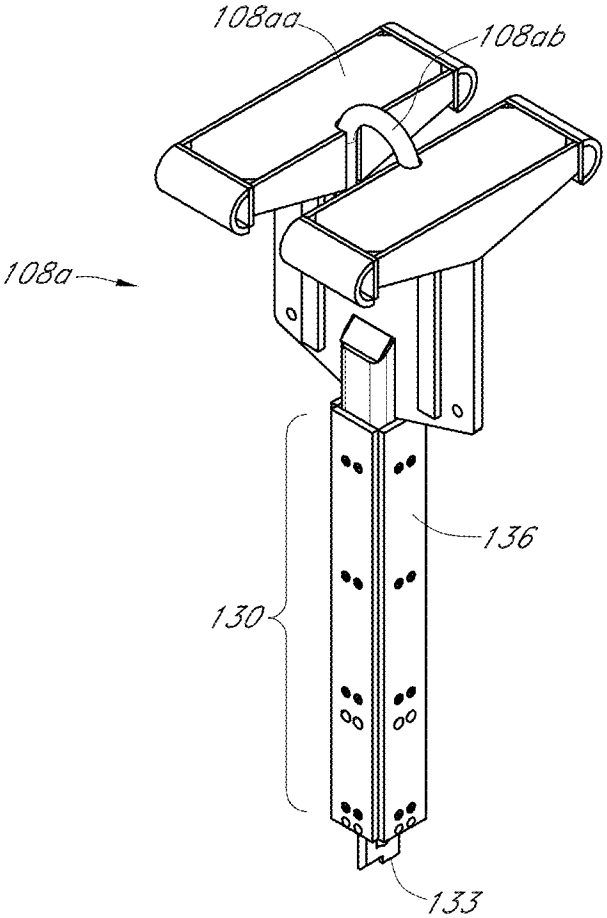
FIG. 14 is a detailed perspective view of the upper works assembly of a 2nd Embodiment of the Load Lifter Assembly as shown in FIG. 12 and throughout the remaining figures.
Figure 14B:
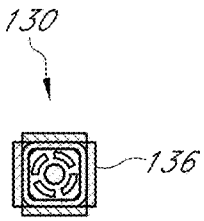
FIG. 14B is a side view of the inner tube of the master switch assembly having a blade positioned at each end of the shaft all located in the inner tube of a 2nd Embodiment of the Load Lifter Assembly as shown in FIG. 12 and throughout the remaining figures.
Figure 14A:
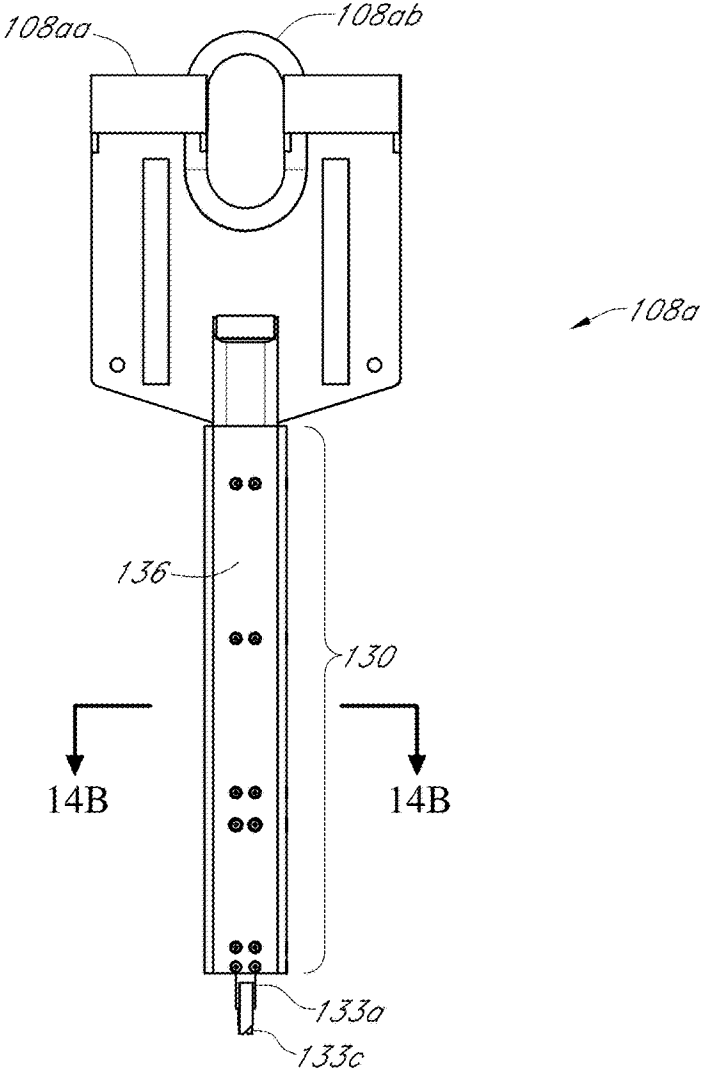
FIG. 14A is a detailed top view of the upper switch assembly of a 2nd Embodiment of the Load Lifter Assembly as shown in FIG. 12 and throughout the remaining figures.
Figure 14C:
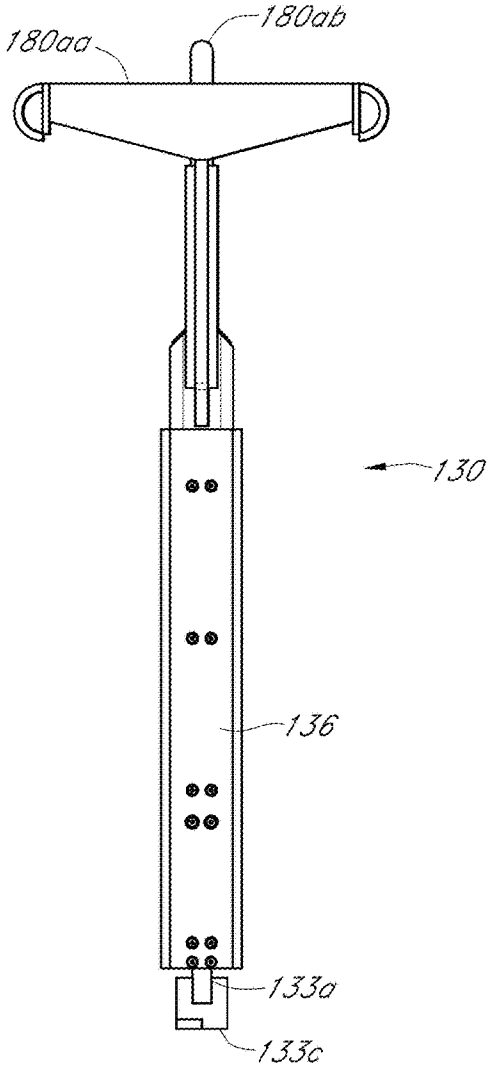
FIG. 14C is a detailed view of the internal shaft of the switch mechanism of a 2nd Embodiment of the Load Lifter Assembly as shown in FIG. 12 and throughout the remaining figures.
Figure 15:
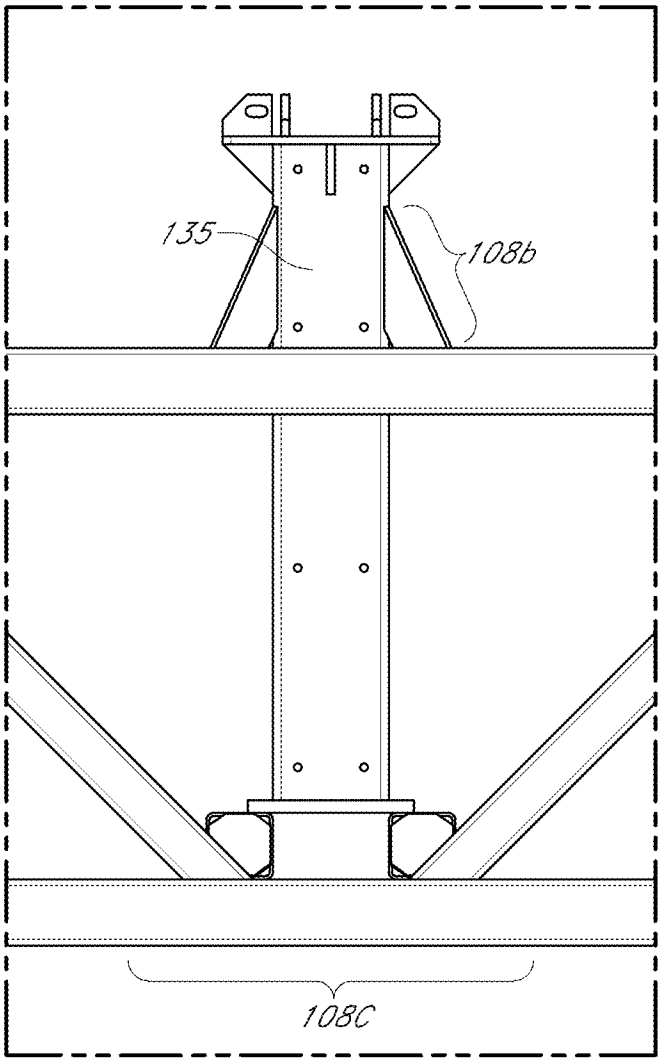
FIG. 15 is a side view of the lifting mechanism of the Load Lifter Assembly of a 2nd Embodiment of the Load Lifter Assembly as shown in FIG. 12 and throughout the remaining figures.
Figure 15A:
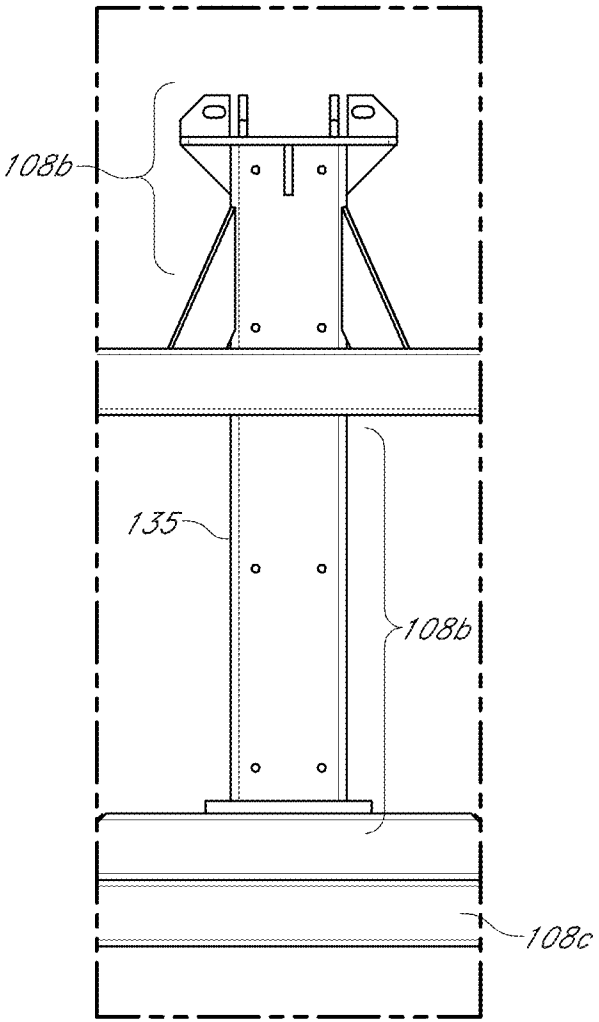
FIG. 15A is an end view of the lifting mechanism of the Load Lifter Assembly of a 2nd Embodiment of the Load Lifter Assembly as shown in FIG. 12 and throughout the remaining figures.

FIGS. 13-14 illustrate the "T" head (108*aa*) and center tubes (135/136) of the 2$^{nd}$ embodiment of the Load Lifter Assembly 200. The "T" head (108*aa*) is welded to the top of the inner square tube 136. At the base of the inner tube 136 is the catch/release mechanism of the master switch assembly 130. The mechanism consists of a shaft with 4" by 4" by ½" steel blades 133*b*/133*c* on each end as shown by FIGS. 14A-14C. The top of the mechanism has a set of wedges 134*a*. There is a base plate 134 below the mechanism that also has a set of wedges 134*a*. (See FIGS. 16A-16B) Each time the load lifter 200 is picked up and sat back down is a cycle. Each cycle rotates the shaft with the blades ¼ turn or 90 degrees. When the shaft with blades is in the lift cycle, the inner tube 136 is allowed to pull up inside the outer tube 135 and the loadarms (120, 122, 124, 126) are pulled in. When sat back down, the shaft with blades rotates another 90 degrees and it is in the release cycle. This picks up the whole load lifter 200 and the hooks 2 come out.

FIG. 18 illustrates the clamshell of the loader 51 engaging the "T" 108*aa* of the load lifter assembly 200 which is engaged with a barge lid of a 2$^{nd}$ Embodiment of the Load Lifter Assembly 200 as shown in FIG. 12 and throughout the remaining figures. As shown in FIG. 18, the swing arms 152 are forward so the hook assemblies 121 are forward and thus the hook engagement surface 121*b* (not shown but understood) is engaged with the eyes 2 of the barge lid 1. (Hook engagement is also illustrated at FIGS. 10C, 11A-11B) FIG. 19 is a top view of the end frame assembly 150 with the wheels 145 resting on the barge lid 1 and the hook surface of FIG. 17-17A of a $2^{nd}$ Embodiment of the Load Lifter Assembly as shown in FIG. 12 and throughout the remaining FIGS. 12-20.

FIG. 20 is a perspective view illustrating the wheels 145 engaged between the ridges in the barge lid 1 with the hook assembly 150 ready for deployment and engagement with the barge lid 1 eyes 2 for a $2^{nd}$ Embodiment of the Load Lifter Assembly 200 as shown in FIG. 12 and throughout the remaining figures.

It is contemplated that in the illustrative embodiments shown in the enclosed figures the Load Lifter Assembly 100/200 may be constructed of, but not limited to, any metal or combination of metals including bronze, steel and aluminum; plastics or carbon fiber including Kevlar®, foam-blown polyurethane, thermoplastic polyurethane, ethylene vinyl acetate, other polymers, other thermoplastics, carbon rubber, blown rubber polymers, composite materials, natural materials (e.g., rubber, leather, etc.), elastomers, combinations thereof, and/or any other material with suitable characteristics (e.g., compressive strength, stability, elasticity, density). This particular embodiment of a Load Lifter Assembly 100/200 was fabricated from steel using various laser cutting, welding, securement and machining technologies which are well known to those of ordinary skill in the art. One of ordinary skill will appreciate that the Load Lifter Assembly 100/200 could be constructed by any method known to those in the art including via casting, forging, and machining or stamping and punching, without restriction or limitation. One of ordinary skill will appreciate that the Load Lifter Assembly 100/200 disclosed herein is designed, fabricated and configured to work with any type of bucket which can engage the upper portion of the load lifter assembly and or any type of cable or chain which be engaged with or wrapped around the load lifter assembly as shown but is in no way limited to working only with particular buckets, cables or chains shown herein.

Having described the preferred embodiments, other features of the Load Lifter Assembly 100 will undoubtedly occur to those versed in the art, as will numerous modifications and alterations in the embodiments as illustrated herein, all of which may be achieved without departing from the spirit and scope of the Load Lifter Assembly 100/200 disclosed herein. Accordingly, the methods and embodiments pictured and described herein are for illustrative purposes only, and the scope of the present disclosure extends to all method and/or structures for providing increased functionality, comfort, longevity, enjoyment and aesthetics in the use and access of Load Lifter Assemblies 100/200. Furthermore, the methods and embodiments pictured and described herein are no way limiting to the scope of the Load Lifter Assembly 100 and method of use unless so stated in the following claims.

It should be noted that the Load Lifter Assembly 100/200 is not limited to the specific embodiments pictured and described herein, but is intended to apply to all similar apparatuses and methods for providing the various benefits and/or features of a Load Lifter Assembly 100/200. Modifications and alterations from the described embodiments will occur to those skilled in the art without departure from the spirit and scope of the Load Lifter Assembly 100/200. It is understood that the Load Lifter Assembly 100/200 as disclosed herein extends to all alternative combinations of one or more of the individual features mentioned, evident from the text and/or drawings, and/or inherently disclosed. All of these different combinations constitute various alternative aspects of the Load Lifter Assembly 100 and/or components thereof. The embodiments described herein explain the best modes known for practicing the Load Lifter Assembly 100/200 and/or components thereof and will enable others skilled in the art to utilize the same. The claims are to be construed to include alternative embodiments to the extent permitted by the prior art.

While the Load Lifter Assembly 100/200 has been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: Maters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as illustrative only, with a true scope and spirit being indicated by the following claims.

What is claimed is:

1. A load lifter assembly for use in lifting operations of barge lids comprising:

a) a main body having an upper portion, a center portion and a lower portion, the upper portion configured for engagement with the working end of a lifting device, the center portion configured to hold and support a switch assembly to control a load engagement system and the lower portion configured for engagement with a load;

b) a first pair of loading legs, each loading leg having a first end and a second end, the first end configured for attachment to the lower portion of the main body and the second end configured with a wheel assembly;

c) a first pair of loading arms, each loading arm having a first end and a second end, the first end configured for attachment to the lower portion of the main body;

d) a second pair of loading legs, each loading leg having a first end and a second end, the first end configured for attachment to the lower portion of the main body and the second end configured with a wheel assembly;

e) a second pair of loading arms, each loading arm having a first end and a second end, the first end configured for attachment to the lower portion of the main body;

f) a first end frame assembly configured for cooperable attachment with the second end of the first pair of loading legs and the second end of the first loading arms for load engagement;

g) a second end frame assembly configured for cooperable attachment with the second end of the second pair of loading legs and the second end of the second loading arms;

h) wherein each of the end frame assemblies further comprises:

i) a support frame, the support frame positioned transverse to the loading legs and positioned exterior of the wheel assembly;

ii) a pair of swing arms, each swing arm rotatably connected at a first end to the interior of the support frame;

iii) a pair of diagonal control frames affixed at each end of the support frame and positioned outside of each of the wheels, wherein the second end of each swing arm is positioned in and extends through each diagonal control frame;

iv) a pair of hook assemblies, each of the hook assemblies configured with a vertical engagement surface and connected at a first portion to the second end of each swing arm; and, i) wherein the switch assembly further comprises an inner tube which is configured to ride up and down inside an outer tube, the outer tube being affixed to the lower portion of the main body and the inner tube being affixed to the upper portion of the main body to allow the load lifter assembly to allow an operator using a lifting device engaged with the load lifter assembly to control engagement and disengagement with the load by the lifting, releasing, and lowering of the load lifting assembly.

2. The load lifter assembly for use in lifting operations of barge lids according to claim 1 wherein the switch assembly is positioned in the center of the main body and is configured to rotate a quarter turn each cycle of lifting, releasing, and lowering the load lifting assembly.

3. The load lifter assembly for use in lifting operations of barge lids according to claim 1 wherein during the cycle of lifting, releasing, and lowering, when the lid is let down, the switch assembly allows the hook assemblies engaged with the barge lid to be released.

4. A load lifter assembly for use in lifting operations of barge lids comprising:

a) a main body having an upper portion, a central rectangular-shaped structure having a center portion and a lower portion, the upper portion configured for engagement with the working end of a lifting device, the center portion configured to hold and support a switch assembly to control a load engagement system and the lower portion configured for engagement with a load;

b) a first loading leg having a first end and a second end, the first end configured for attachment to the lower portion of the main body, the second end configured for engagement with the load;

c) a second loading leg having a first end and a second end, the first end configured for attachment to the lower portion of the main body, the second end configured for engagement with the load;

d) a third loading leg having a first end and a second end, the first end configured for attachment to the lower portion of the main body, the second end configured for engagement with the load;

e) a fourth loading leg having a first end and a second end, the first end configured for attachment to the lower portion of the main body, the second end configured for engagement with the load;

f) a first loading arm positioned proximate the first loading leg and configured for actuation by the switch assembly for engagement and disengagement with the load;

g) a second loading arm positioned proximate the second loading leg and configured for actuation by the switch assembly for engagement and disengagement with the load;

h) a third loading arm positioned proximate the third loading leg and configured for actuation by the switch assembly for engagement and disengagement with the load;

i) a fourth loading arm positioned proximate the first loading leg and configured for actuation by the switch assembly for engagement and disengagement with the load; and, j) a first end frame assembly configured for cooperable attachment with the second end of the first and third loading legs and the second end of the first and the third loading arms for load engagement;

k) a second end frame assembly configured for cooperable attachment with the second end of the second and fourth loading legs and the second end of the second and fourth loading arms for load engagement;

l) wherein each of the end frame assemblies further comprises:

i) a support frame, the support frame positioned transverse to the loading legs and positioned exterior of the wheel assembly;

ii) a pair of swing arms, each swing arm rotatably connected at a first end to the interior of the support frame;

iii) a pair of diagonal control frames affixed at each end of the support frame and positioned outside of each of the wheels, wherein the second end of each swing arm is positioned in and extends through each diagonal control frame;

iv) a pair of hook assemblies, each of the hook assemblies configured with a vertical engagement surface and connected at a first portion to the second end of each swing arm; and, m) wherein the switch assembly further comprises an inner tube which is configured to ride up and down inside an outer tube, the outer tube being affixed to the center portion of the main body and the inner tube being affixed to the upper portion of the main body to allow the load lifter assembly to allow an operator using a lifting device engaged with the load lifter assembly to control engagement and disengagement with the load by the lifting, releasing, and lowering of the load lifting assembly.

5. The load lifter assembly for use in lifting operations of barge lids according to claim 4 wherein the switch assembly is positioned in the center of the main body and is configured to rotate a quarter turn each cycle of lifting, releasing, and lowering the load lifting assembly.

6. The load lifter assembly for use in lifting operations of barge lids according to claim 4 wherein during the cycle of lifting, releasing, and lowering, when the lid is let down, the switch assembly allows the hook assemblies engaged with the barge lid to be released.

* * * * *